US007770624B2

(12) United States Patent
Ni et al.

(10) Patent No.: US 7,770,624 B2
(45) **Date of Patent: *Aug. 10, 2010**

(54) OVERHEAD GARAGE DOOR

(75) Inventors: Xiao-Ming Ni, Zhejiang (CN); Jennifer Armstrong Maher, Chevy Chase, MD (US)

(73) Assignee: FrenchPorte IP, L.L.C., Rockville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/621,360

(22) Filed: Jan. 9, 2007

(65) Prior Publication Data

US 2007/0175602 A1 Aug. 2, 2007

Related U.S. Application Data

(63) Continuation-in-part of application No. 11/277,466, filed on Mar. 24, 2006, and a continuation-in-part of application No. 11/328,454, filed on Jan. 10, 2006, and a continuation of application No. 11/229,713, filed on Sep. 20, 2005, now abandoned.

(51) Int. Cl.
*E06B 3/48* (2006.01)

(52) U.S. Cl. ..... 160/229.1; 160/201; 160/40

(58) Field of Classification Search ..... 160/201, 160/229.1, 236, 235, 40; 49/383, 496.1, 49/483.1; 16/355

See application file for complete search history.

(56) References Cited

U.S. PATENT DOCUMENTS

| | | | | |
|---|---|---|---|---|
| 3,221,465 | A * | 12/1965 | Mckee | 52/656.4 |
| 5,148,850 | A * | 9/1992 | Urbanick | 160/231.1 |
| 2003/0000656 | A1 * | 1/2003 | Zen | 160/201 |
| 2007/0175601 | A1 * | 8/2007 | Ni et al. | 160/201 |

FOREIGN PATENT DOCUMENTS

| | | | |
|---|---|---|---|
| DE | 103 10 628 | A1 | 10/2004 |
| WO | 98/41723 | A | 9/1998 |
| WO | 2004/029395 | A2 | 4/2004 |

OTHER PUBLICATIONS

International Search Report dated Nov. 21, 2007.

* cited by examiner

*Primary Examiner*—Blair M. Johnson
(74) *Attorney, Agent, or Firm*—Banner & Witcoff, Ltd.

(57) ABSTRACT

An overhead garage door has an apparatus for pinch resistant operation. The garage door may include horizontal sections and the door may be formed from a plurality of these sections, arranged in a stack, and pivotally connected to adjacent sections. The apparatus, such as meeting rails, may be attached to adjacent horizontal sections to mask the appearance of a seam created as adjacent sections are joined or provide pinch resistant operation.

10 Claims, 31 Drawing Sheets

OVERHEAD GARAGE DOOR

CROSS REFERENCE TO RELATED APPLICATIONS

This application is a continuation-in-part of, and claims the benefit of priority to, U.S. patent application Ser. No. 11/277,466, filed Mar. 24, 2006 which claims the benefit of priority to Chinese Design Patent Application Nos. 200630105541.7 and 200630105542.1, both filed on Mar. 13, 2006 in China and is a continuation-in-part of the U.S. patent application Ser. No. 11/328,454, filed Jan. 10, 2006, which is a continuation-in-part of U.S. patent application Ser. No. 11/229,713 filed Sep. 20, 2005, which is a continuation of U.S. patent application Ser. No. 10/098,384, filed Mar. 18, 2002, now U.S. Pat. No. 6,948,547, entitled "Overhead Garage Door With Decorative Facade Elements." The contents of the noted above applications are expressly incorporated herein by reference.

TECHNICAL FIELD

This invention generally pertains to a sectional door having an apparatus for pinch resistant operation. More particularly, the present invention pertains to a sectional door pinch resistant apparatus that conceals seam lines between hingedly-connected sections of a sectional door, such as an overhead garage door, and to an overhead garage door having the same.

BACKGROUND

Garage doors are generally known in the art as structures that form a movable barrier in an entryway to a garage or other type of building. Conventional overhead garage doors are formed from a vertical stack of horizontally folding sections interconnected by hinges and supported by a guide track.

Visible seams are created in these conventional doors where the horizontal panels of the door meet when in the closed, vertical position. These seams detract from the aesthetics of the door and may allow moisture, wind and debris to penetrate through the garage door. Repeated use of the door over extended periods may cause these seams to widen further, allowing more moisture, wind and debris into the garage, reducing the insulation capabilities of the door and further detracting from the aesthetics of the door.

In additional, conventional doors have a problem of a user's finger being potential engaged between the door sections on a closing operation. This problem is a hazard has not been adequately addressed by previous door designs.

SUMMARY

Aspects of the present invention provide a sectional door having pinch resistant apparatus between hingedly-connected sections of the door when the door is moved in a closed position. In addition, aspects of the present invention provide good sealing capabilities at the seams of such a door in a closed position to prevent moisture, wind and debris from penetrating through the door. Further aspects provide an overhead garage door formed of hingedly-connected sections that interconnect while in the closed position to provide a robust, rigid door.

In one embodiment, a sectional door includes a set of meeting rails installed on adjacent, hingedly-connected sections of the door. The meeting rails mask the seam created where the adjacent sections meet when in a closed position. In addition, the meeting rails can provide improved sealing and insulation for the door by providing a barrier against moisture, wind and debris.

DETAILED DESCRIPTION OF THE DRAWINGS

Figure 1:
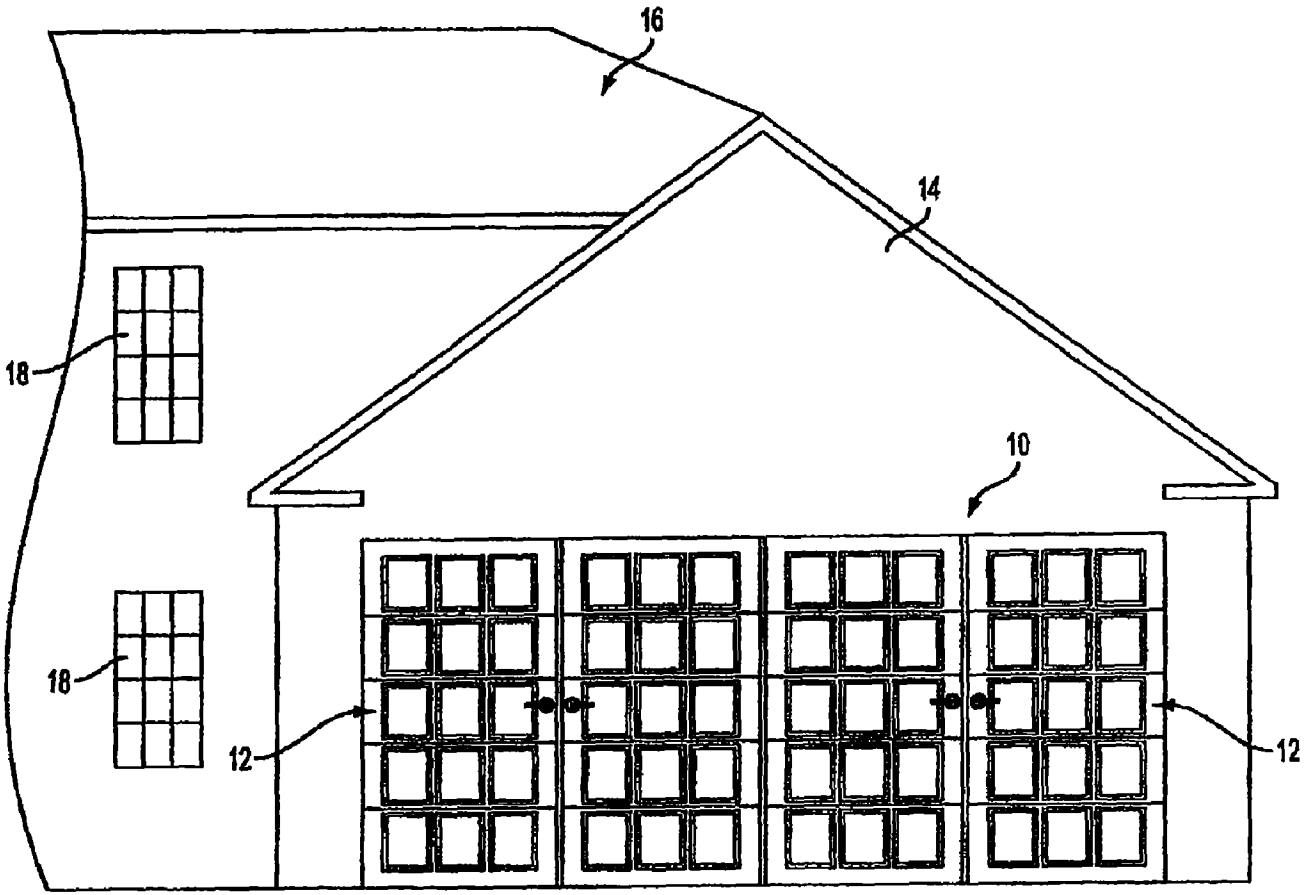
FIG. 1 shows a portion of a house with an attached garage having an embodiment of an overhead garage door in accordance with the present invention.

One embodiment of the present invention is the overhead garage door 10 depicted in FIG. 1 that includes decorative facade elements 12 that simulate a set of four light-transmitting doors known commonly as French doors. A set of French doors typically includes two doors each having an array of divided lights. In the garage door 10, the lights are light-transmitting panels that transmit visible light.

Figure 2:
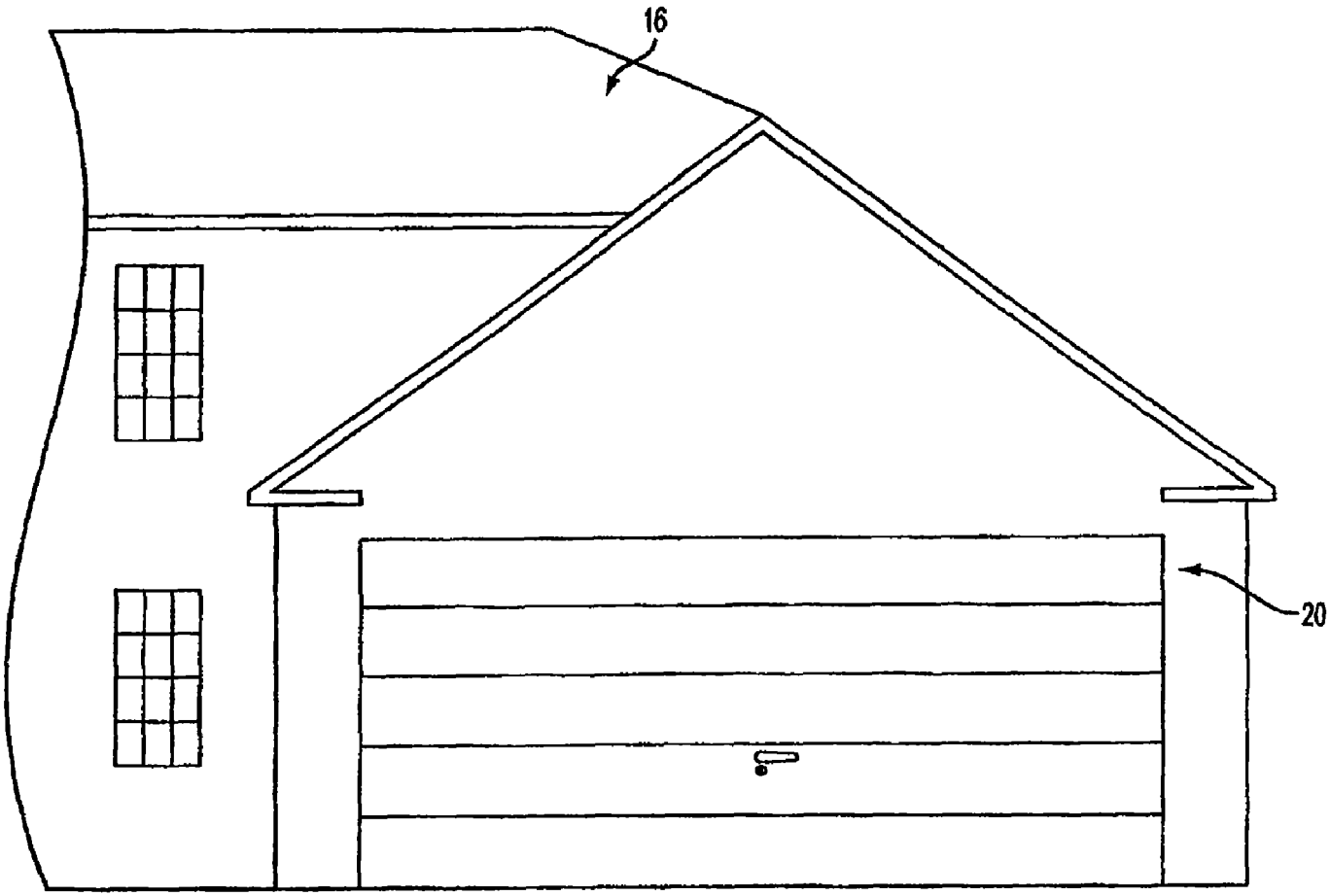
FIG. 2 PRIOR ART
FIG. 2 shows the house of FIG. 1, but with a conventional overhead garage door.

The garage door 10 is shown installed on a garage 14 of a conventional house 16. For illustration purposes, the house includes divided light windows 18. The facade elements 12 give the garage door 10 an attractive appearance that blends well with the style of the house 16, particularly with the divided light windows 18 of the house. In contrast, FIG. 2 shows a conventional garage door installed on the same conventional house 16. Rather than blending in with the style of the house 16, the conventional garage door 20 stands out as a monolithic blank space that detracts from the appearance of the house.

Figure 3:
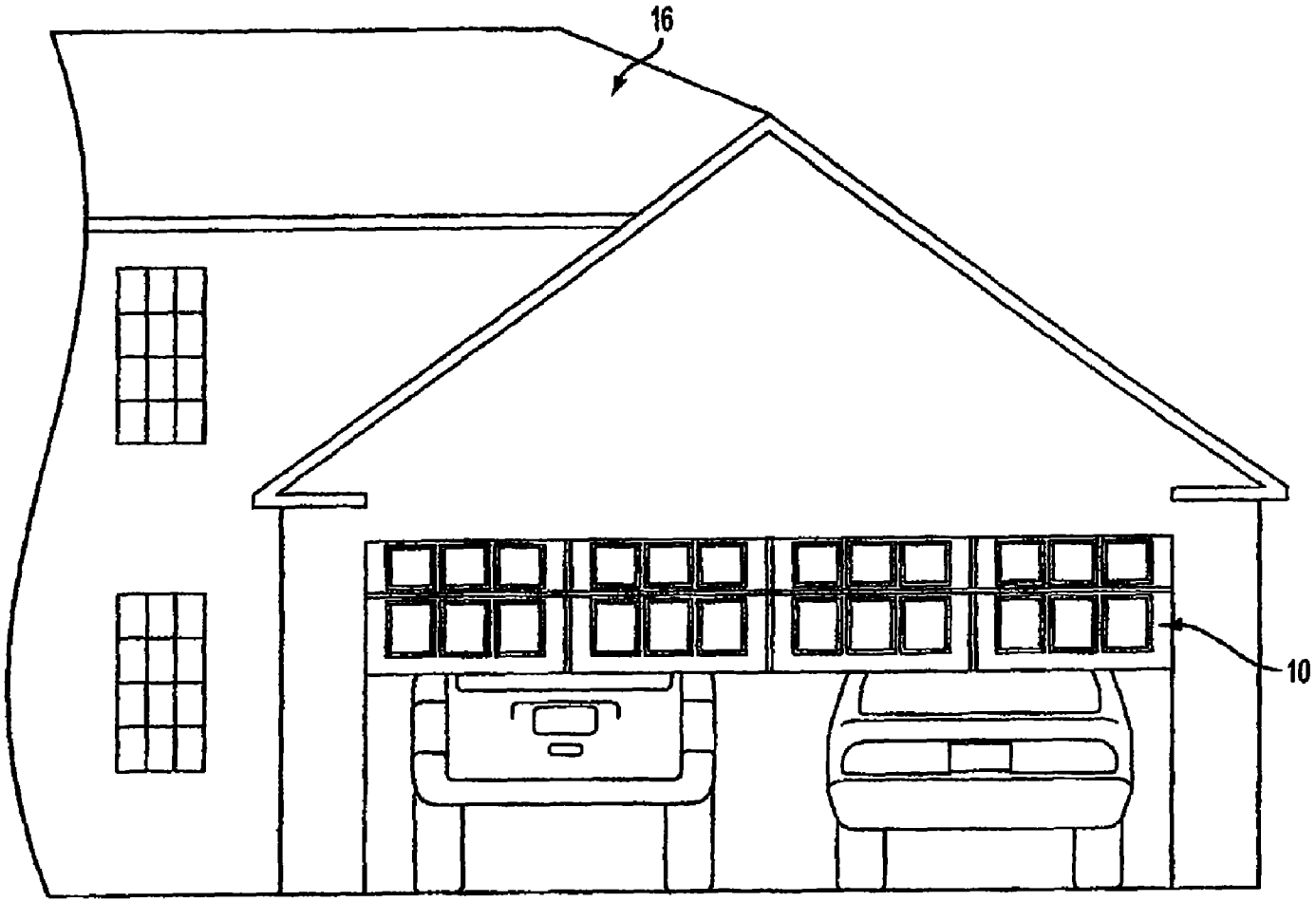
FIG. 3 shows the garage door of FIG. 1, but with the overhead garage door shown in a partially opened condition.

Referring now to FIGS. 4-7, the overhead garage door 10 includes a door 22, four arrays 24 of light-transmitting panels 26, guide rollers 28, and guide tracks 30. The door 22 includes sections 32 arranged in a stack, and hinges 34 pivotally connecting adjacent sections 32. Guide rollers 28 are connected to edge portions of the sections 32 and are retained in a guide track 30 attached to the garage. The track has a vertical section and a horizontal section and extends at a right angle from a vertical position to a horizontal position. The guide rollers 28 are each received in a channel 31 in one of the guide tracks 30. The garage door 12 opens and closes by rolling on the guide rollers along the guide tracks 30 from a vertical closed position to an overhead horizontal open position, and vice versa, as is known in the art. To illustrate, FIG. 3 shows garage door 10 in a position intermediate between the opened and closed position. Although embodied herein as a sectioned garage door, the present invention works as well with unitary, slab-type overhead garage doors as are known in the art, or with other types of overhead garage doors.

Figure 4:
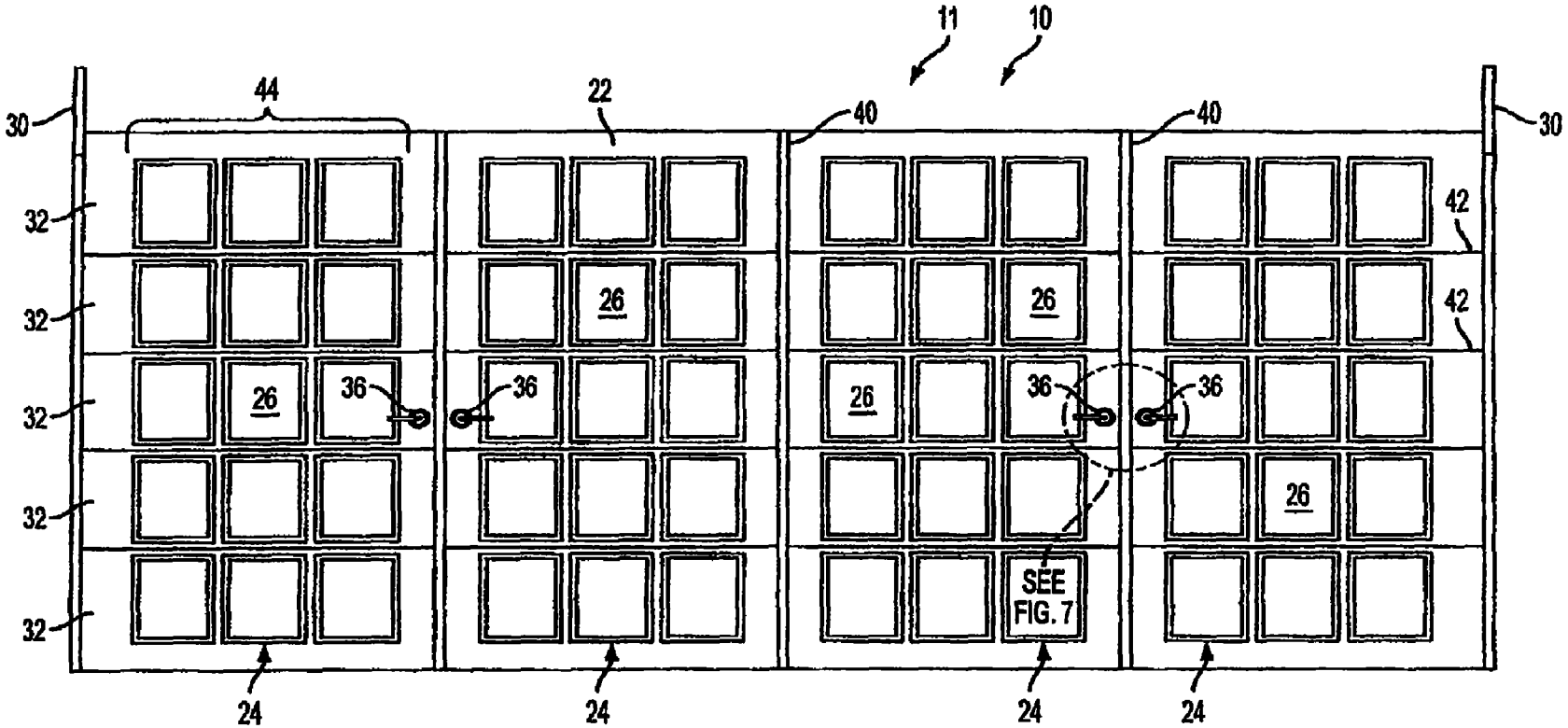
FIG. 4 is an exterior elevational view of the garage door of FIG. 1, including guide rails for connecting the door to the garage.
Figure 5:
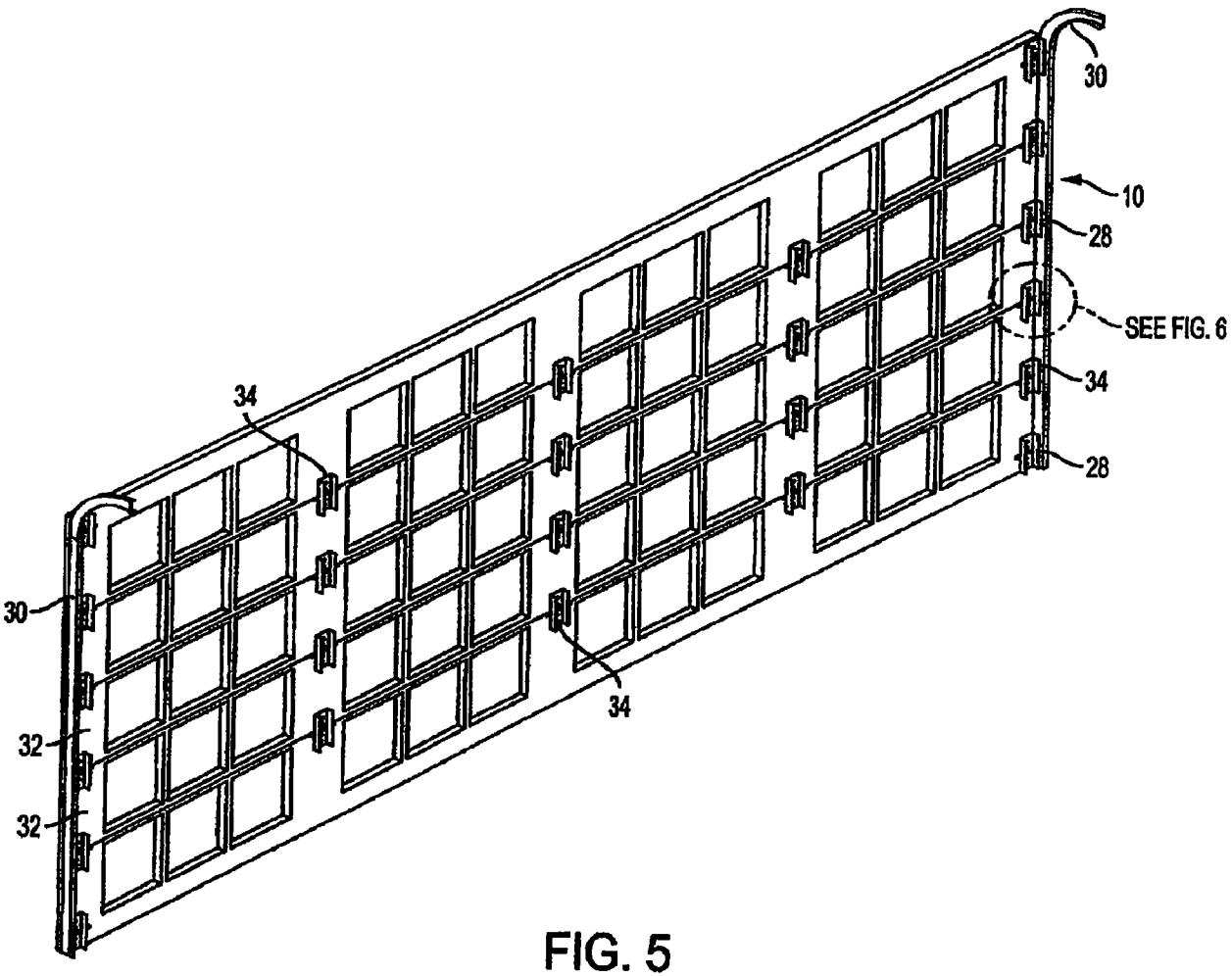
FIG. 5 shows an interior perspective view of the garage door of FIG. 4.
Figure 6:
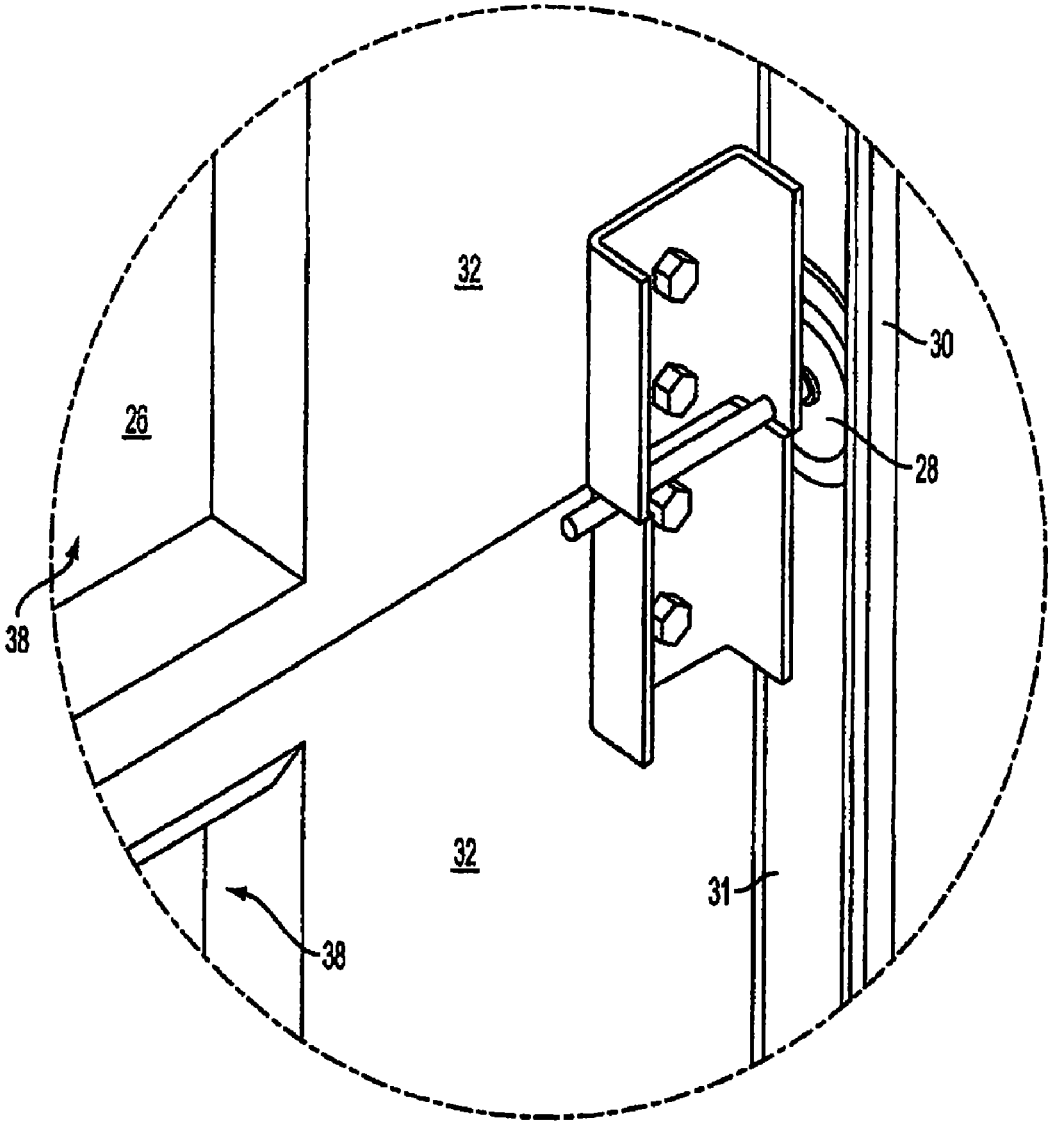
FIG. 6 shows a close-up perspective view of an interior portion of the garage door of FIG. 5, including a roller connected to a guide rail.
Figure 7:
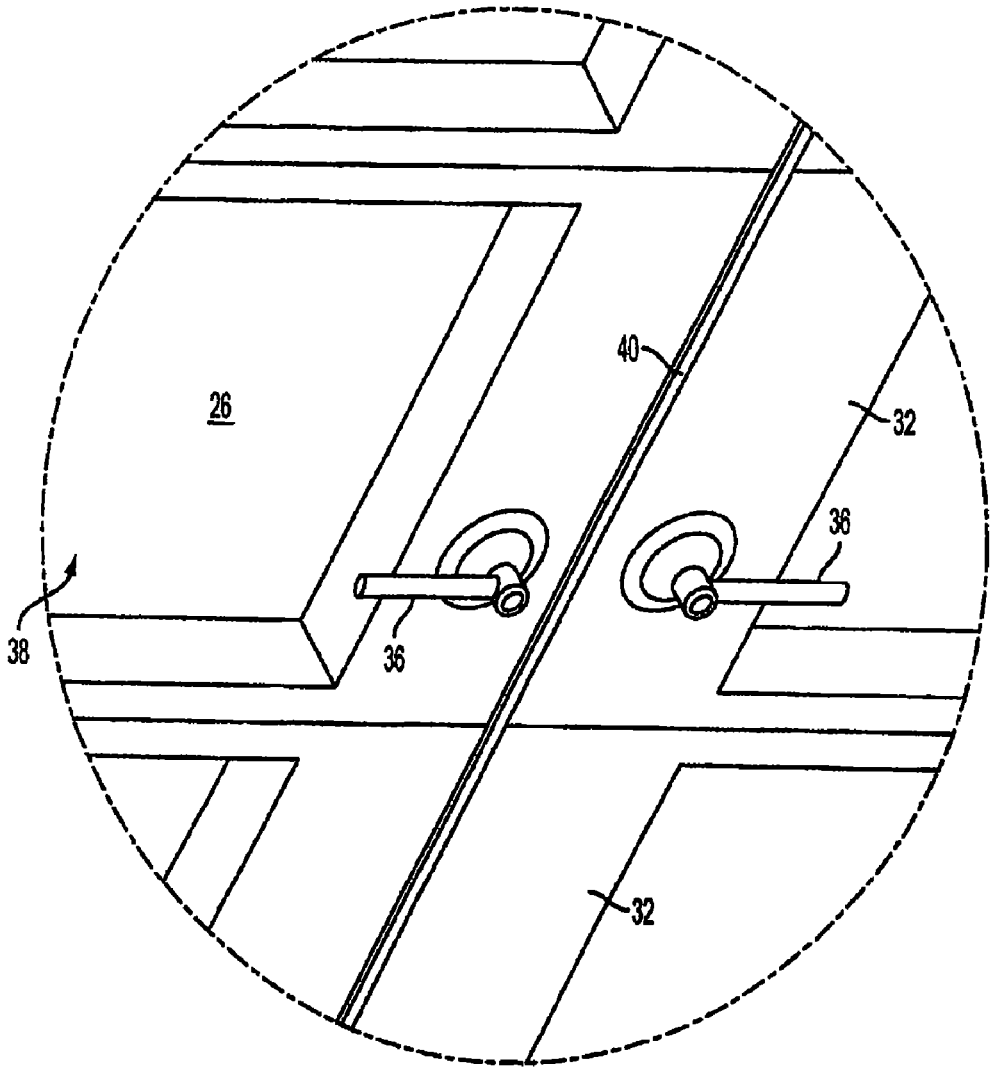
FIG. 7 shows a close-up perspective view of an exterior portion of the garage door of FIG. 4, including a vertical groove and door handles.

The arrays 24 of light-transmitting panels 26 shown in FIGS. 1 and 3-5 each include five rows by three columns, which generally match the appearance of regular French doors. The arrays 24 are spaced from one another along the door 22 to give the appearance of four separate passage doors. To enhance the appearance of separate doors, the overhead garage door 10 further includes door handles 36. Each array 24 in combination with a corresponding handle 36 generally forms a facade element 12 to simulate a light-transmitting door. Although the door handles 36 do not function to open the simulated doors 24, they may act as functional latches for opening the garage door 10 or as handles for lifting the garage door 10. To further simulate the appearance of French doors, each one of the light-transmitting panels 26 appear to be glazed in a section 32 as shown in FIGS. 6 and 7, which is similar to the manner in which glass is often glazed in window frames. Accordingly, beveled moldings 38 are provided in the sections 32 for retaining the light-transmitting panels 26. The panels 26 retained therein are able to transmit light from the outside environment into the interior of the garage 14.

The light-transmitting panels 26 preferably are translucent panels, which provide the benefit of transmitting light between the outside environment and the interior of the garage 14 without allowing persons outside of the garage 14 to clearly see into the garage. Thus, the present invention allows in a greater amount of natural light into the garage 14 compared with a conventional garage door. According to other embodiments, the light-transmitting panels 26 may include transparent panels, reflective panels, tinted panels, one-way mirrored panels, and the like to provide a desired level of privacy without sacrificing light. Further, the door arrays 24 may include a mix of different panel types, and may include opaque panels. Thus, the quantity of light transmitted into and out of the garage 14 can be custom tailored according to the light transmissibility of each one of the panels 26.

The panels 26 are preferably made of material which can be customized in appearance and strong enough to be a barrier in an environment that is prone to weather exposure, shop conditions, or other adverse environments. One example of such a material is polycarbonate acrylic sheets, which are light-weight and provide high impact resistance. These sheets can be made to have various light transmission properties, which can range from transparent to opaque. Polycarbonate acrylic sheets can also be made in a variety of colors and tints. The present invention further contemplates panels 26 made from a wide variety of plastics, glass, or other light-transmitting materials.

To enhance the effect of the facade elements 12 in simulating French doors, the door 22 also includes three vertical grooves 40. Each groove 40 is placed between a pair of panel arrays 24 to simulate the jambs of a set of adjacent doors. The grooves 40 additionally emphasize the appearance of simulated doors by drawing the eye away from the horizontal lines 42 created by the junction of adjacent sections 32. The grooves 40 are accentuated in comparison with the horizontal lines 42 by being much wider and deeper than the horizontal lines. Painting the grooves a dark color further increases their visual effect.

The garage door 10 of the present invention can be created from a kit 11 for making an overhead garage door that simulates a set of light-transmitting doors. Referring specifically to FIGS. 4 and 5, the kit 11 generally includes a number of sections 32 and a number of hinges 34 for connecting the sections 32. A row of light-transmitting panels 26 are mounted on each section 32, and the panels of each row are arranged in groups 44 of three panels spaced apart from adjacent groups. The garage door 10 is created by arranging the sections 32 into a stack to form the door 22, and connecting adjacent sections 32 to each other with hinges 34. The kit 11 also includes guide rollers 28 and guide tracks 30 for mounting the assembled door to a garage, and door handles 36 for mounting on one of sections 32.

Figure 14:
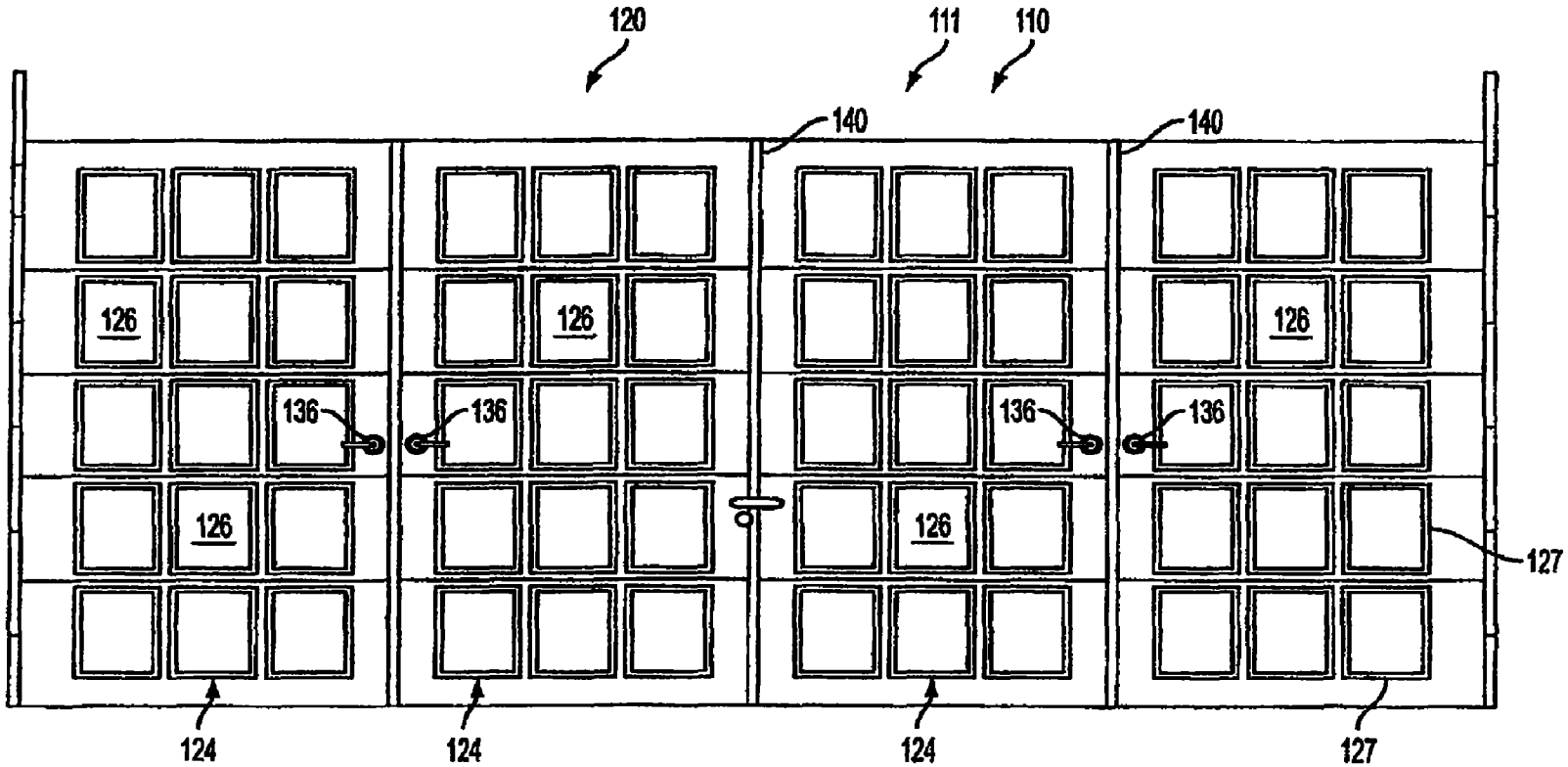
FIG. 14 shows an exterior elevational view of an additional embodiment of an overhead garage door in accordance with the present invention.

A garage door 110 according to another embodiment of the present invention can be created from a retrofit kit 111 for modifying the appearance of an existing overhead garage door to simulate a set of light-transmitting doors. Referring to FIG. 14, the retrofit kit 111 generally includes decorative panels 126 and door handles 136. The decorative panels 126 are mounted to a conventional garage door 120 (such as the conventional garage door 20 shown in FIG. 2) in a set of arrays 124 to give it the appearance of a set of French doors. In order to allow light to transmit through the panels 126, holes (not shown) may be cut into the garage door 120 prior to mounting the panels. The panels may be mounted over or within the holes (not shown) according to known methods. The panels may include beveled edges 127 to simulate the frame elements of a French door. The handles 136 are each mounted next to an array 124 to further simulate light-transmitting doors. An optional vertical stripe 140 may be painted onto the garage door 120 to simulate the jambs of adjacent simulated French doors.

Figure 8:
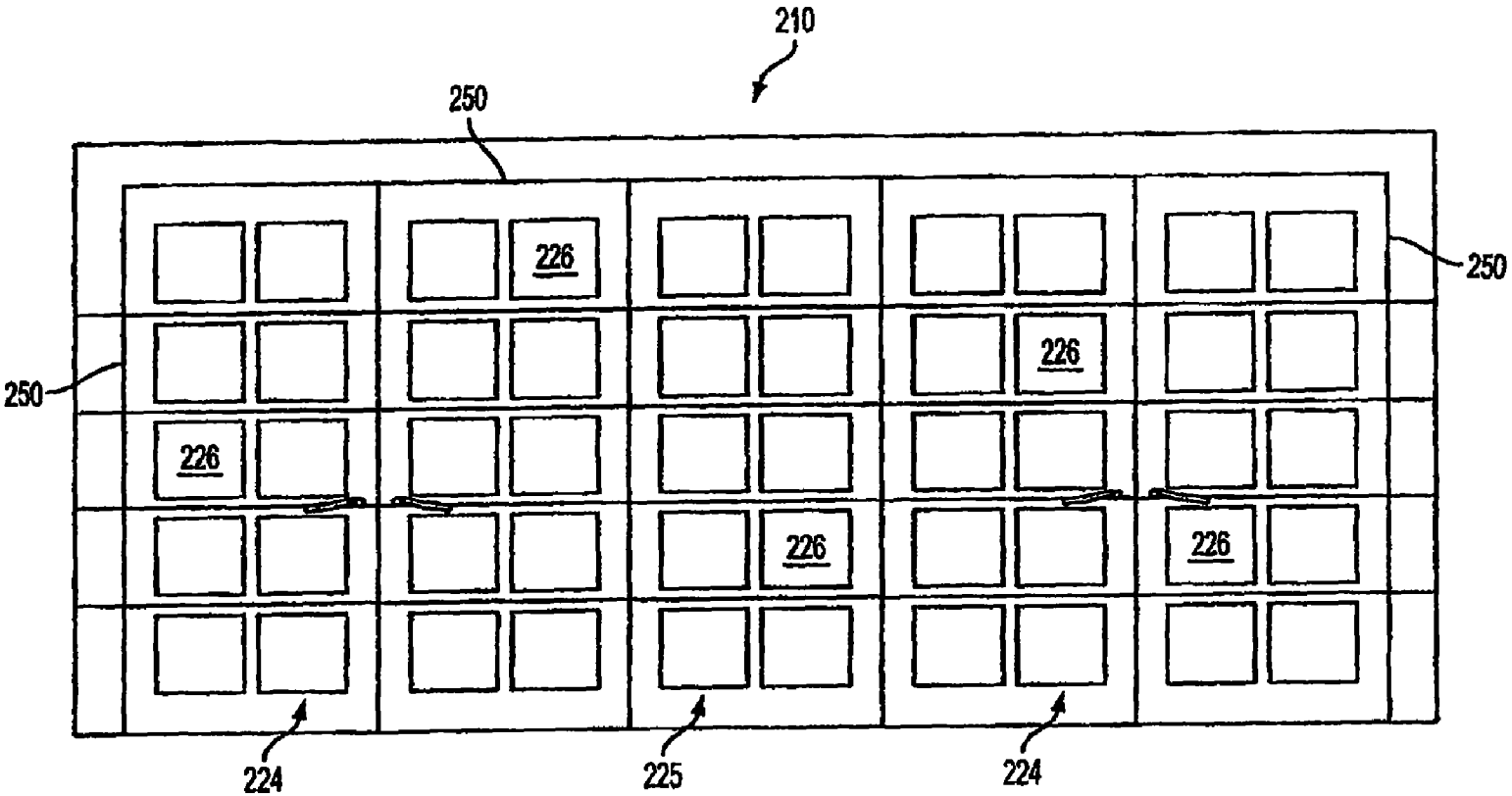
FIG. 8 shows an exterior elevational view of another embodiment of an overhead garage door in accordance with the present invention.

The present invention is flexible in that it allows for variety in the design of facades and in the types of light-transmitting doors simulated. For example, a further embodiment of an overhead garage door in accordance with the present invention is shown in FIG. 8. In this embodiment, there are five arrays 224 of light-transmitting panels 226 simulating a set of four light-transmitting doors centered about a window array 225. The arrays 224 are arranged into two by five arrays having two columns and five rows. The garage door 210 further includes borders 250 simulating the jambs and top edges of each simulated door and the window. The borders 250 are preferably formed by grooves in the garage door, but may also be formed from painted stripes, adhesive strips, and other methods for marking a border. Except for preferences and aspects related to number, arrangement and size of arrays 224, or to the simulated borders 250, all other preferences and aspects are generally the same as for the previous embodiments.

Figure 9:
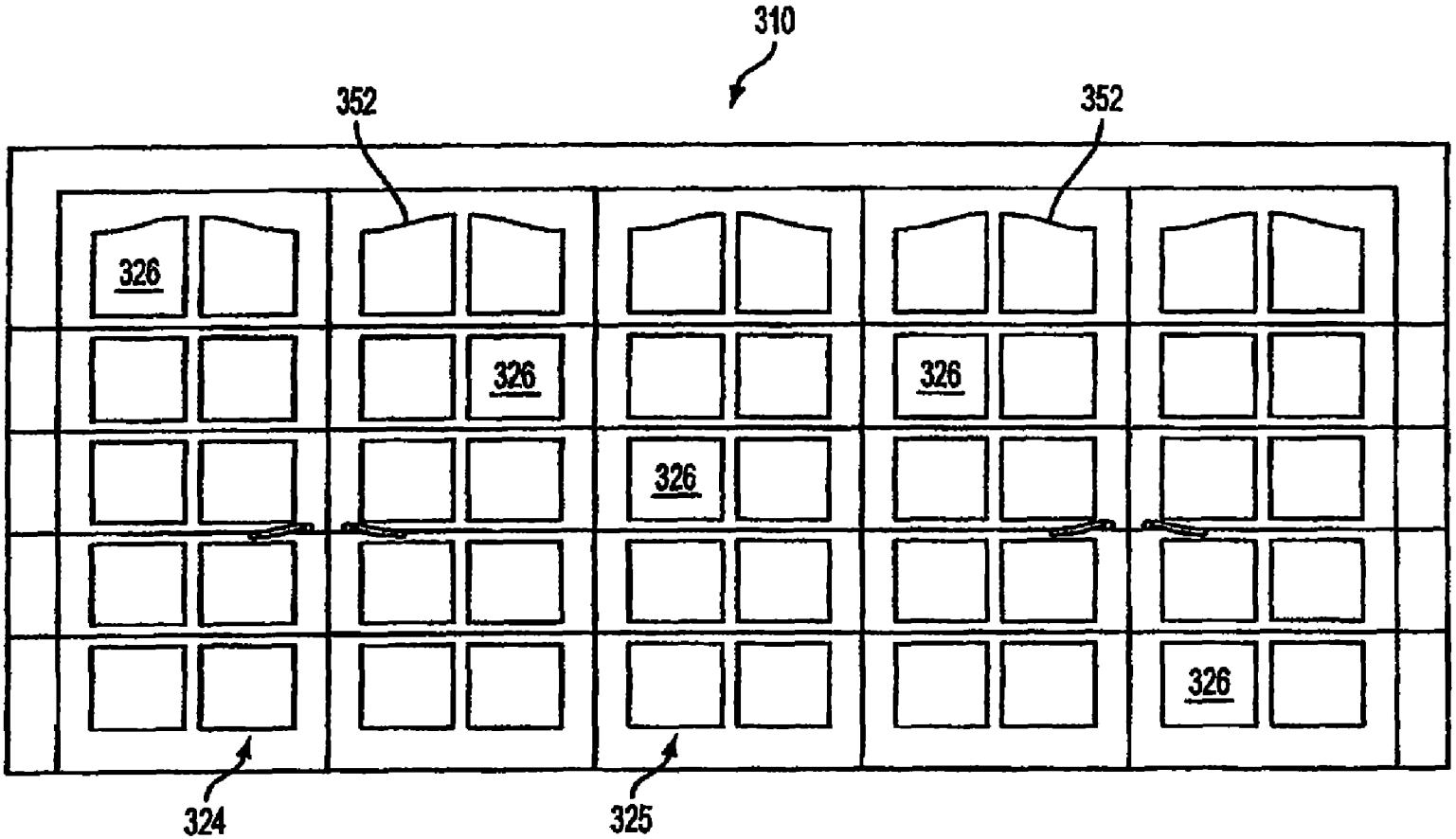
FIG. 9 shows an exterior elevational view of a further embodiment of an overhead garage door in accordance with the present invention.
Figure 10:
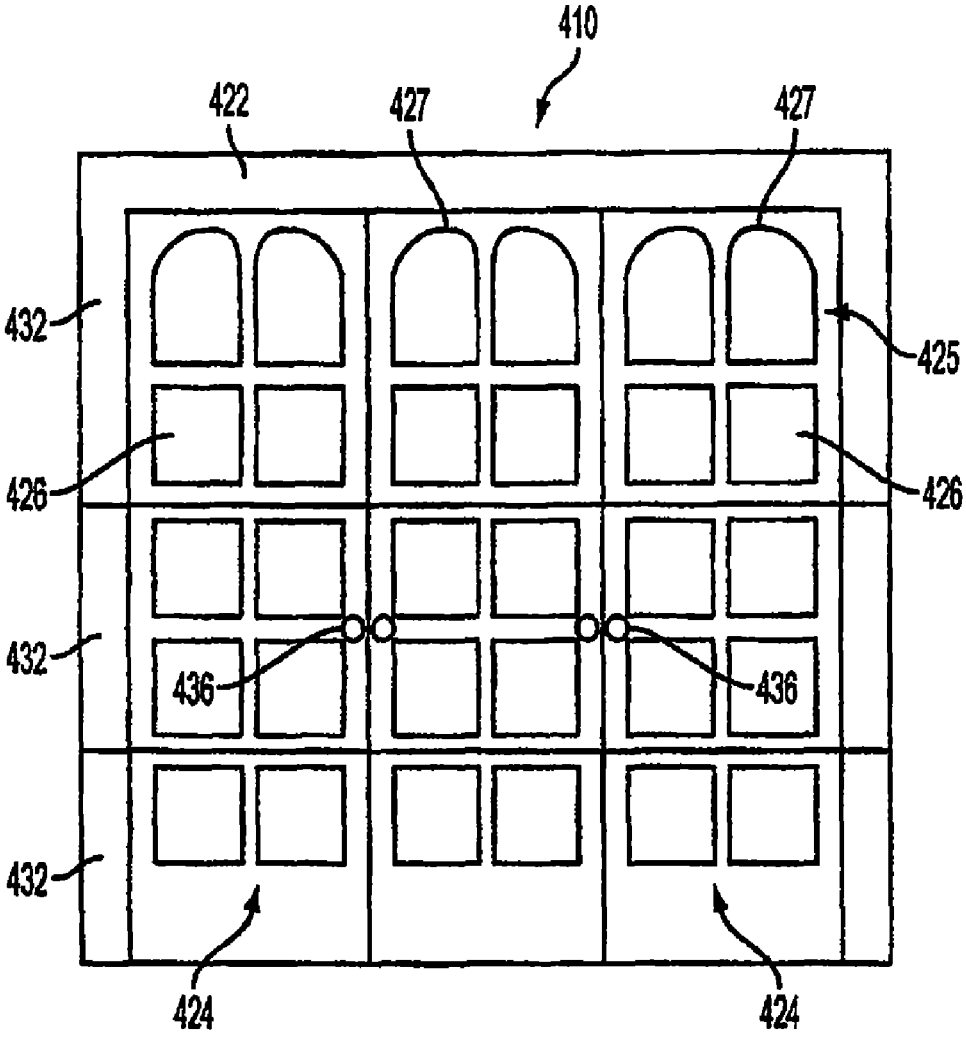
FIG. 10 shows an exterior elevational view of yet another embodiment of an overhead garage door in accordance with the present invention.
Figure 11:
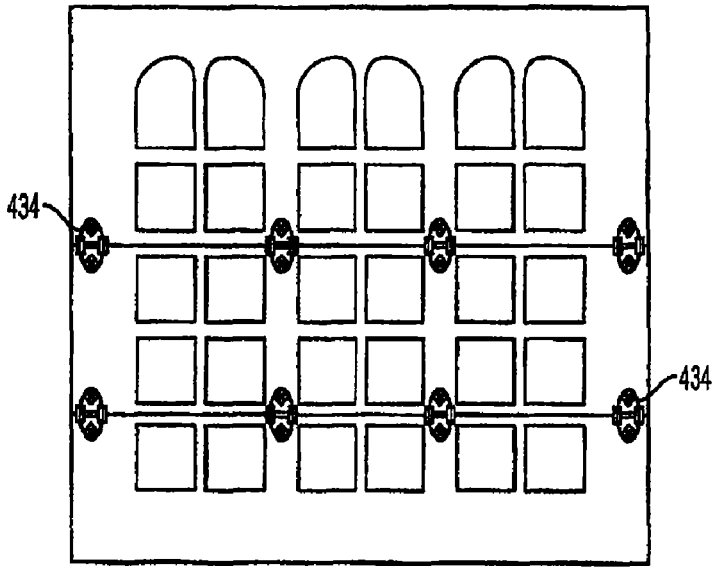
FIG. 11 shows an interior elevational view of the garage door of FIG. 10.
Figure 12:
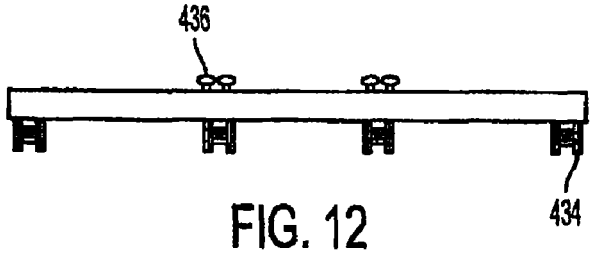
FIG. 12 shows a top view of the garage door of FIG. 10.
Figure 13:
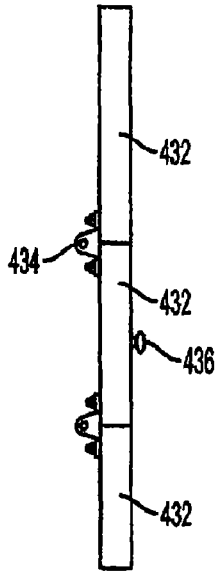
FIG. 13 shows a side view of the garage door of FIG. 10.

The present invention also provides flexibility in the size and type of panels used for the simulated light-transmitting doors. For example, an additional embodiment of an overhead garage door 310 in accordance with the present invention is shown in FIG. 9. This embodiment differs from the embodiment shown in FIG. 8 in that each panel in the top row of panels 326 include an ornate arching curvature 352 along its top edge. As illustrated in the top row 352, the panels 326 need not be rectangular or uniform in size and shape, and may include any number of decorative variations.

Referring now to FIGS. 10-13, yet another embodiment of an overhead garage door 410 in accordance with the present invention is shown. This embodiment demonstrates further flexibility in design according to the present invention, particularly for garage door design as well as for panel design and array layout. The garage door 410 according to this embodiment generally includes a door 422 and three arrays 424 of light-transmitting panels 426 simulating a set of three light-transmitting doors. The door 422 includes three sections 432 arranged in a vertical stack, and hinges 434 pivotally connecting adjacent ones of sections 432. The sections 432 in this embodiment are of different sizes, with the top section being wider than the middle section and bottom sections, and the middle section being wider than the bottom section. The arrays 424 are arranged into two by five arrays having two columns and five rows.

The garage door 410 represented by this embodiment demonstrates a number of design differences from other embodiments. For example, the panels 426 located in the top row 425 of each array are taller than the panels located in lower rows. In addition, each panel in the top row 425 has an arcuate top edge 427. Although the panels 426 are arranged into five rows, the panels are spaced over only three sections 432. Accordingly, the top two rows in each array are located on the top section, the middle two rows in each array are located on the middle section, and the lower row of each array is located on the lower section. As such, the simulated windows in each of the simulated doors appear to be upwardly offset from the bottom of the corresponding simulated door. The garage door 410 further includes round doorknobs 436 to enhance the appearance of doors.

Referring now to FIGS. 15-19 another embodiment of an overhead garage door 510 is shown that illustrates various aspects of the present invention pertaining to seams between the hingedly-connected sections, such as concealing the seams and improving the interconnection of adjacent sections at the seam region therebetween. As with the previous embodiments, garage door 510 includes decorative facade elements, such as light-transmitting panels 512, which simulate two sets of light-transmitting doors commonly known as French doors. However, aspects of the present invention pertaining to seams between the sections may be practiced with other door configurations, which may or may not simulate light-transmitting doors or even include light-transmitting elements.

Figure 15:
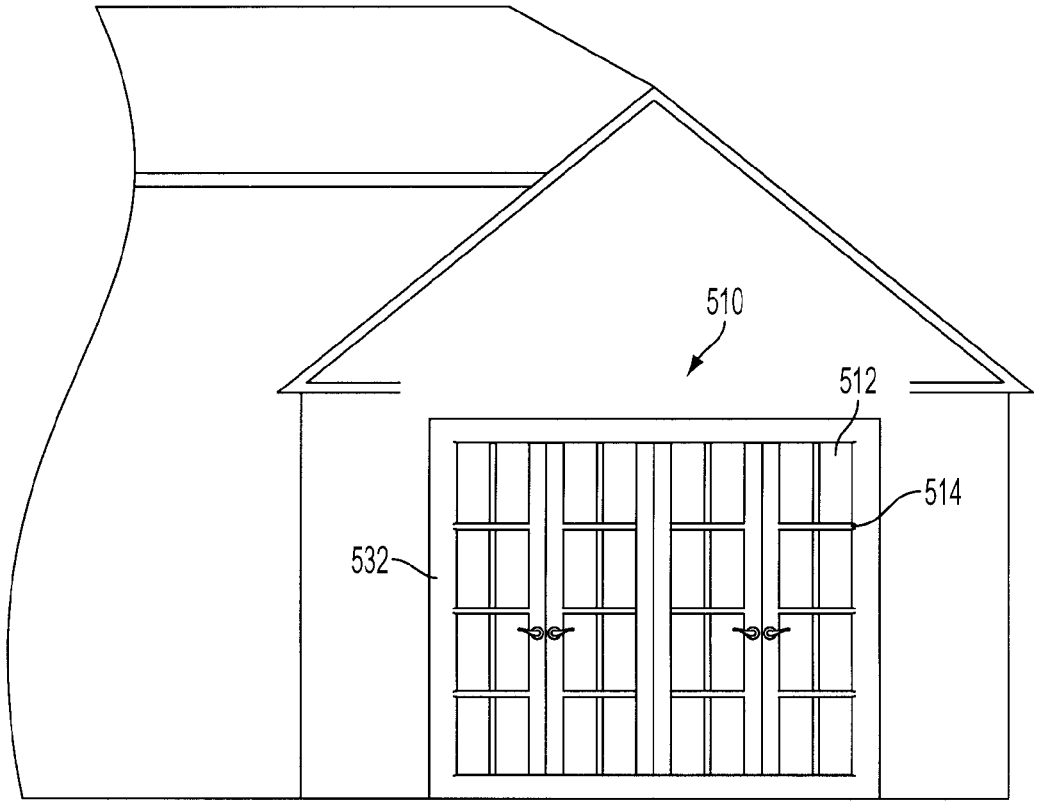
FIG. 15 shows an exterior elevational view of yet another embodiment of an overhead garage door in accordance with the present invention.
Figure 16:
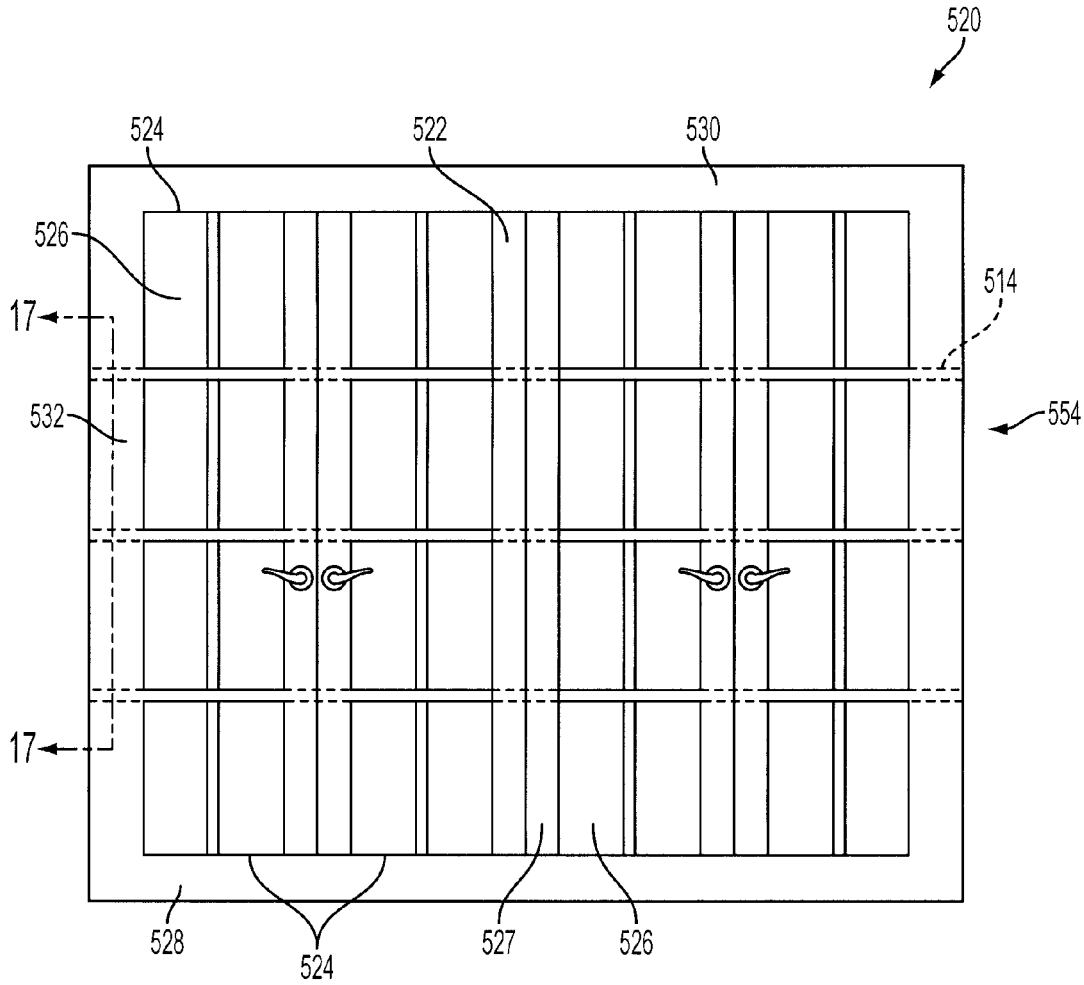
FIG. 16 is a front elevational view of the garage door of FIG. 15.

As shown in FIGS. 15 and 16, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 18:
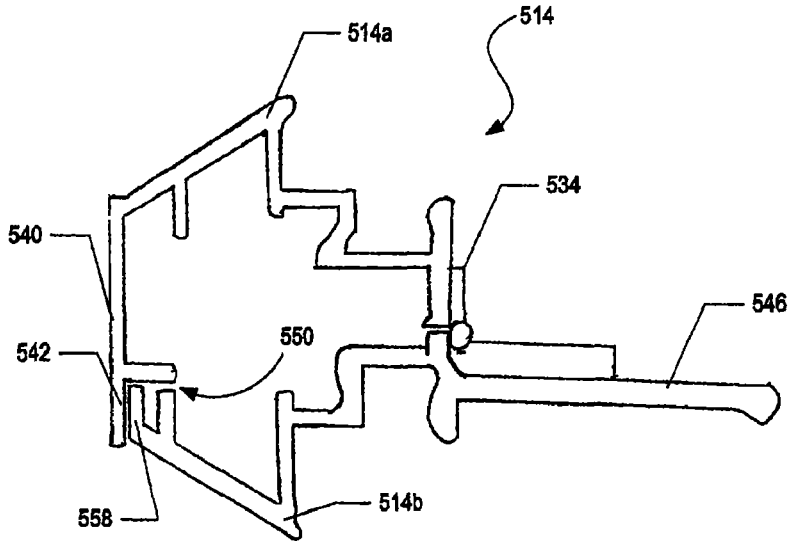
FIG. 18 is a cross sectional view of the set of meeting rails of FIG. 16.

Garage door 510 also includes a concealing apparatus, such as meeting rails 514, which are located at the joint between adjacent horizontal sections 532. As shown in FIG. 18, the meeting rails 514 are a pair of complementary pieces, an upper meeting rail 514*a* and a lower meeting rail 514*b*, that are joined by a hinge, such as surface mounted hinge 534. As the door 510 moves between a horizontal, open position and a vertical, closed position, adjacent sections 532 bend about hinge 534 to accommodate the angled transition between the two positions. Upper meeting rail 514*a* is attached to a bottom portion of an upper section 532 and rotates about hinge 534 with respect to lower meeting rail 514*b*, which is attached to an upper portion of an adjacent section. When the horizontal sections 532 are stacked in a closed position, a seam 550 (FIG. 18) is created where the two sections meet. Meeting rails 514 act as a concealing apparatus to mask seam 550 that is formed between adjacent sections.

Figure 17:
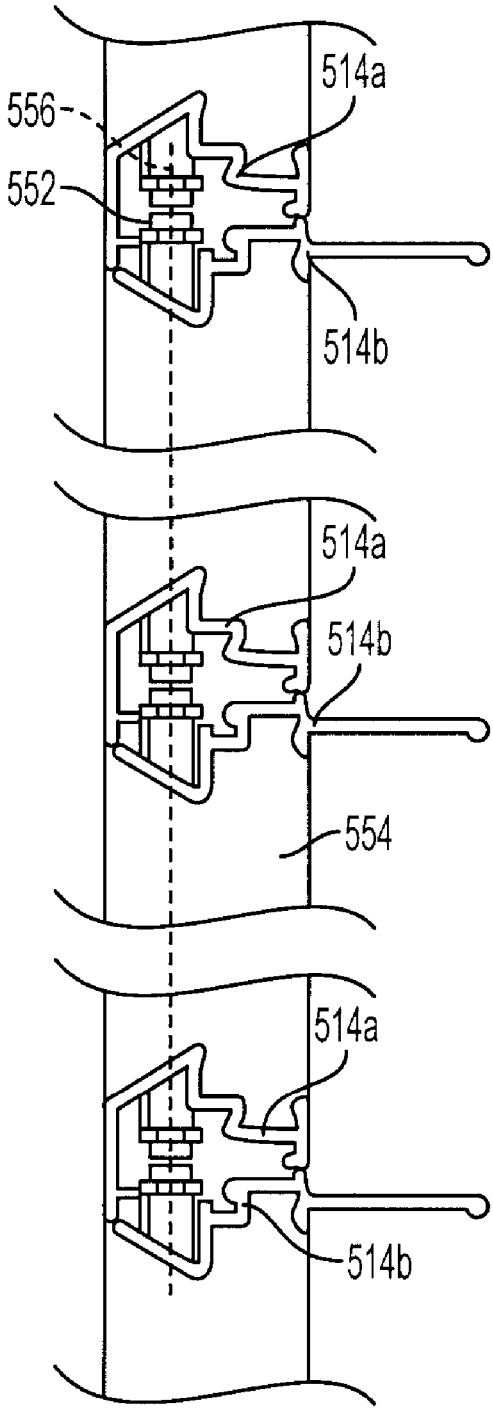
FIG. 17 is a cross sectional view of the garage door of FIG. 16 taken along line 17-17.

A pair of meeting rails for a particular section can be attached to each other via through bolts or other fasteners connecting them to the body of their respective section. As shown in FIG. 17, a first meeting rail (e.g., 514*a*) for a particular section can be connected to an opposite meeting rail (e.g., 514*b*) for the particular section via fasteners, such as a series of through bolts 552. As shown, bolt 552 extends vertically from the first one of the rails, through a body portion 554 of the section, and to the opposite one of the rails. If the section is one of the top or bottom sections for the door, the through bolt could attach to either the top stile 530 (FIG. 16) or the bottom stile 528 and extend through the section's body to a rail on the opposite side of the section. As further shown in FIG. 17, through bolts 550 may include a collar 556 that is bevel cut to mate with geometric features (e.g., angles) of the respective meeting rail 514*a* or 514*b*, which can strengthen the structural connection and aid with its assembly.

Through bolts 552 act in tension to draw the opposite rails or rail/stile pair toward each other and, thereby, to sandwich the body portion between the pair in compression. As shown in FIG. 16, the body portion 554 can include an arrangement of light-transmitting panels 526 and structural supports 527, such as solid panels. As discussed above for other embodiments, the panels may be formed from metal (e.g., aluminum), wood or other types of support materials.

Meeting rails 514*a* and 514*b* may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, or thermoforming plastic materials. In addition, the meeting rails 514*a* and 514*b* can be manufactured to appear as a material similar to that of the rest of the door and of the same color to match the exterior appearance of the door 510.

As further shown in FIG. 18, upper rail 514*a* and lower rail 514*b* are preferably asymmetrical. As discussed further below, their asymmetrical shapes can provide advantages, such as masking seams between door sections, aiding the assembly and structural integrity of door sections, and enhancing door rigidity in the closed position. Upper rail 514*a* can include a flat front surface 540 that is visible on the front of garage door 510 when installed. The flat front surface 540 can reduce the appearance of seam lines created by adjoining horizontal sections 532. The flat front surface 540 is configured to cover the seam between the section to which it is attached and the adjacent section and, thereby, to provide a more aesthetically pleasing door than one having visible seams. As shown, lower rail 514*b* may have an extended flange 546 that provides a surface to which hinge 534 can be mounted. As the door is raised or lowered, the meeting rails 514*a* and 514*b* rotate apart about hinge 534 to allow the door to move to the open or closed position.

In addition to providing aesthetic benefits gained by concealing seams between sections, the flat front surface 540 of upper rail 514*a* can also aid the insulation properties of the door. The flat front surface 540 includes an overlap 542 that overlaps a corresponding under surface 558 of the lower rail and, thereby, provides a tight seal at seam 550. The overlap seal configuration can provide protection against air and moisture seeping between the horizontal panels of the door and, thus, provide a weather-tight seal. The overlap seal configuration further prevents any moisture that may possibly seep behind the flat front surface 540 from penetrating further. Any such moisture would meet with under surface 558 of the lower rail and will not be able to penetrate to the inside of the door. The overlap seal configuration also encourages precipitation and other fluids contacting the exterior of the door to move downward past the seam without being able to enter it. In general, the overlap seal configuration acts as a barrier against wind, moisture and debris, to reduce undesired infiltration into the garage.

Additional advantages can be realized when a concealing apparatus, such as meeting rails 514, is used with a sectional door having aesthetic features, such as facade elements or other elements that simulate the appearance of something other than a sectional door. For instance, the use of meeting rails 514 with an overhead garage door that incorporates French door facade elements can enhance the facade elements by concealing the seams 550 between adjacent sections. The seams created by the adjoining horizontal pieces can detract from the appearance of the door and the desired look created by the French door design. Concealing the horizontal seams in such an overhead garage door provides a uniform door appearance that is consistent with actual French doors and other types of vertically hinged doors.

Figure 19:
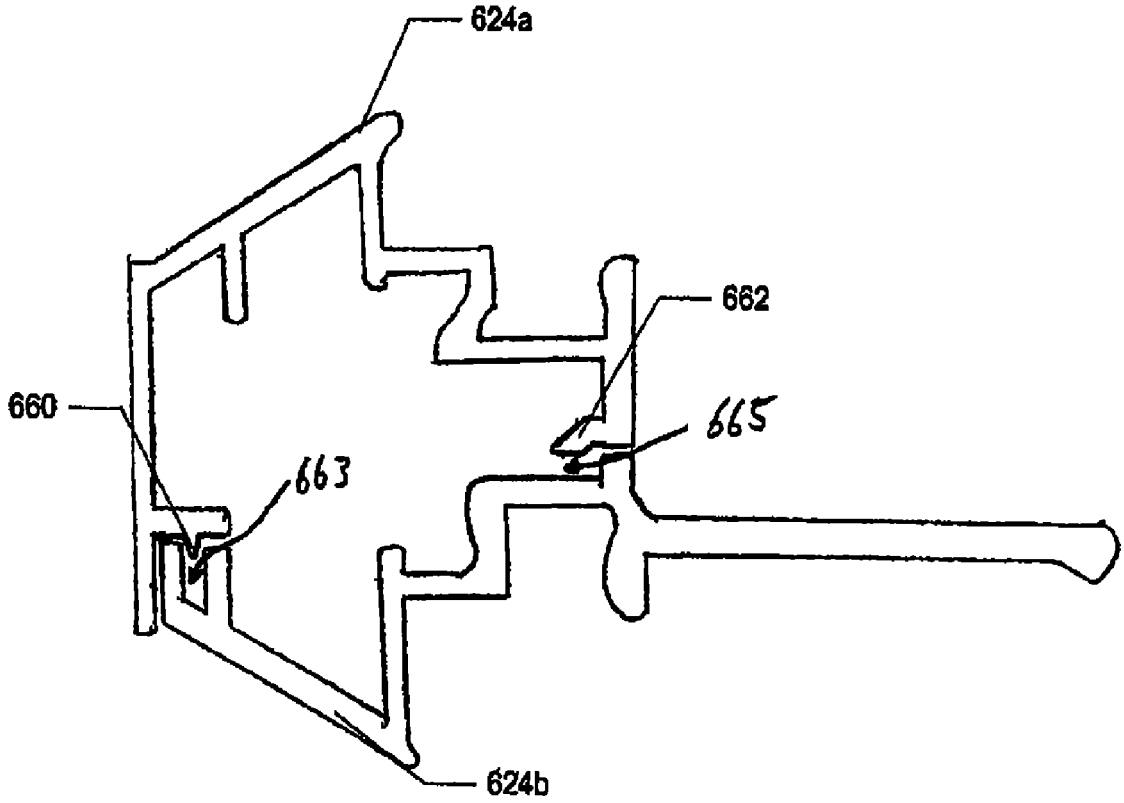
FIG. 19 is a cross sectional view of a set of meeting rails according to another embodiment of the invention.

FIG. 19 depicts an alternate embodiment of the meeting rails 624*a* and 624*b* for use with a sectional door, such as garage door 510. Upper meeting rail 624*a* includes an additional lip 660 protruding downward. This lip 660 may be located on a horizontal portion of the rail adjacent to the flat front surface 640 of upper guide 624*a*. An additional lip 662 may be located on the upper guide 624*a* and may protrude from the vertical back portion of the upper guide 624*a*. This lip protrudes toward the flat front surface 640 and downward toward the lower meeting rail 624*b*. The additional lips 660 and 662 may be formed in each of the meeting rails 624*a* and 624*b* during manufacture. For instance, the meeting rails 624*a* and 624*b* can be formed by an extrusion process to include additional lips 660 and 662.

Additional lips 660 and 662 can aid in installation of the meeting rails 624*a* and 624*b*. The lips 660 and 662 can assist with aligning the meeting rails 624*a* and 624*b* to thereby simplify installation of adjacent sections to each other. In addition, the lips 660 and 662 can aid with locking the meeting rails 624*a* and 624*b* together while the door is in a closed position. The lips 660 and 662 permit the upper meeting rail 624*a* to interconnect with corresponding recesses 663 and 665 of the lower meeting rail 624*b* to enhance the security and structural integrity of the door when in the closed position.

Figure 20:
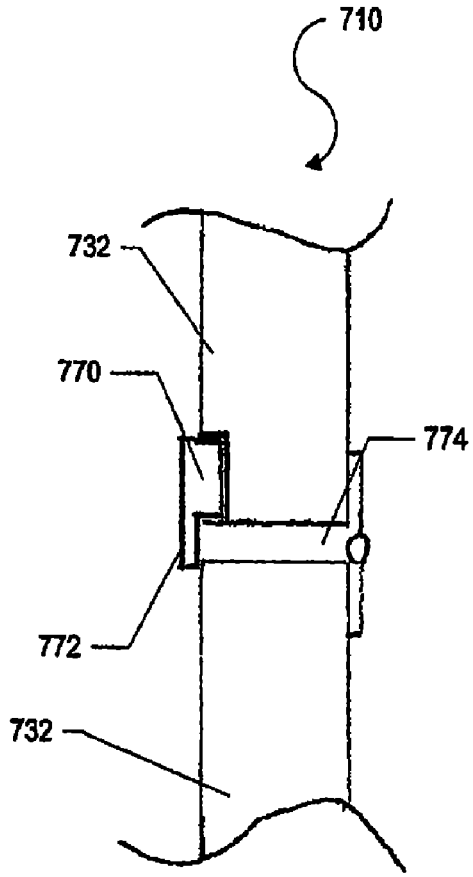
FIG. 20 is a cross sectional view of a portion of an overhead garage door according to a further embodiment of the invention.

FIG. 20 shows a concealing apparatus 710 according to another embodiment of the invention. As shown, concealing apparatus 710 generally includes an overlap plate 770 attached to a lower portion of a door section 732, such that it overlaps and conceals a gap 774 formed between adjacent sections. Plate 770 may be attached to garage door section 732 by way of a fastener, e.g., screw, bolt, and the like. The overlap plate 770 may also have an overlapping portion 772 that can conceal a seam 774 created between two adjoining horizontal sections 732 of the garage door 710. The overlap plate 770 can act as a barrier against wind, moisture and debris and will also mask the seam 774 to improve the appearance of the door 710.

Referring to FIG. 15 and FIGS. 21 through 24A-E, an alternative embodiment of an overhead garage door 510 is shown that illustrates various aspects pertaining to providing a pinch resistant function between the hingedly-connected sections. Referring generally to FIG. 15, garage door 510 may include decorative façade elements, such as light-transmitting panels 512, which simulate two sets of light-transmitting doors commonly known as French doors. However, aspects of the present invention pertaining to pinch resistant functions between the door sections may be practiced with other door configurations, which may or may not simulate light-transmitting doors or include light-transmitting elements.

Referring to FIG. 15, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 21:
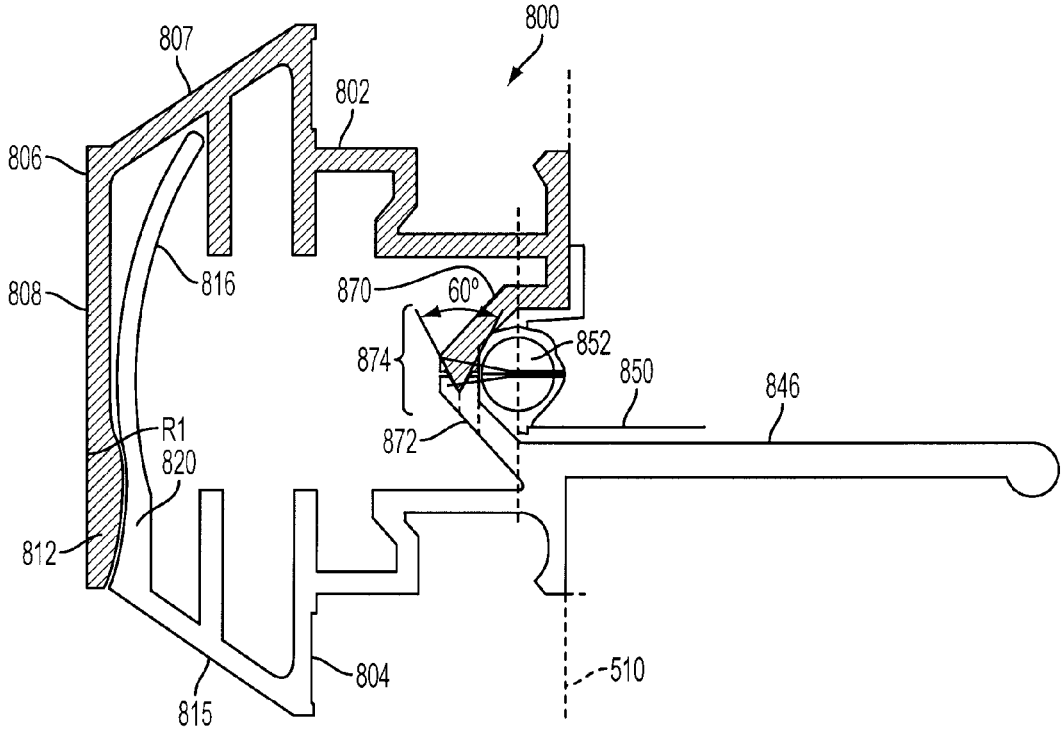
FIG. 21 is a cross section view of a meeting railing system according to one embodiment.
Figure 22:
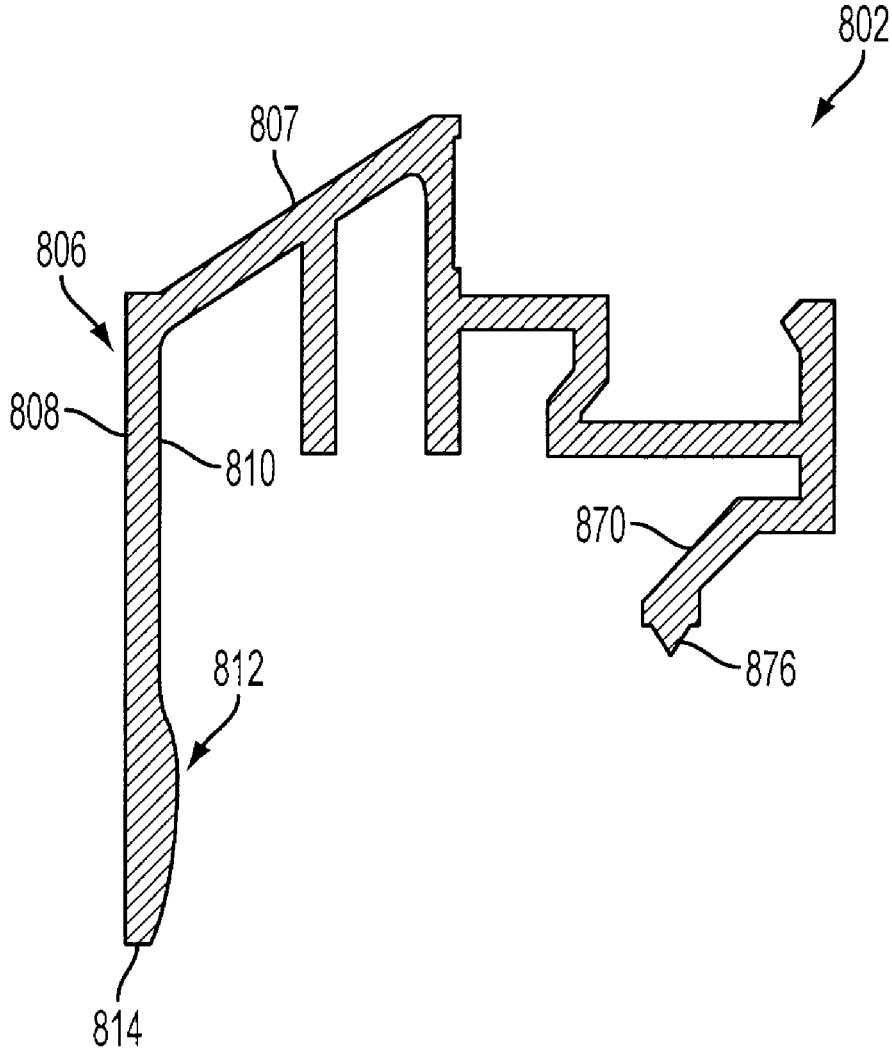
FIG. 22 is a cross section view of one member of the meeting rail system shown in FIG. 21.
Figure 23:
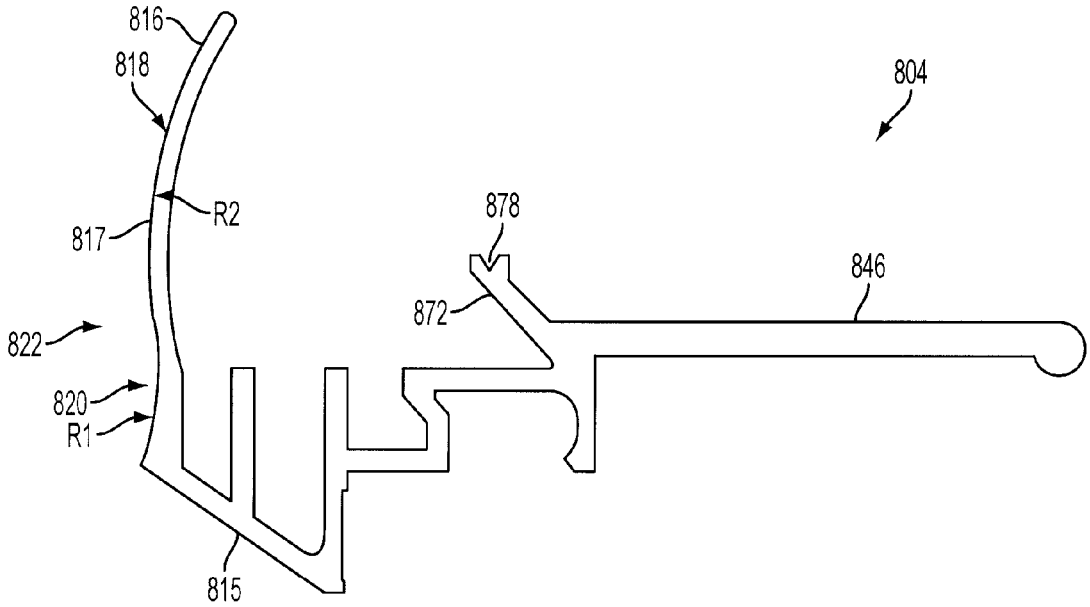
FIG. 23 is a cross section view of one member of the meeting rail system shown in FIG. 21.

FIGS. 21-23 illustrate an alternative embodiment of the meeting rail system 800 for a garage door 510 (FIG. 15). The meeting rail system 800 is configured to provide a pinch resistant type of garage door to protect the detents of a user's limb, such as a finger of the user, from being engaged between the horizontal sections 532. Meeting rail system 800 comprises an upper rail 802 and a lower rail 804. The upper rail 802 and lower rail 804 are provided between adjacent horizontal sections of the door 510. The upper rail 802 is mounted to the upper horizontal section to extend laterally across the width of the door 510. Likewise, the lower rail is mounted the lower section of the door. The upper rail 802 and the lower rail 804 are hingedly connected together to move in a complementary manner when the garage door sections 532 move on the guide track (not shown). In one construction shown in FIGS. 21 and 22, the upper meeting rail 802 includes a vertical leg 806 which has a front face 808 and a rear face 810. The front face 808 is substantially planar, but could have other surface configurations. The rear face 810 includes a convex protrusion portion 812 disposed near the distal end 814 of the vertical leg 806. The remainder of the rear face 810 is substantially planar, but could be other configurations. The vertical leg 806 is connected to an angular portion 807 which is mounted to the bottom end of the door section.

Referring to FIGS. 21 and 23, the lower meeting rail 804 is provided with an upstanding portion 816 having a front face 817 with a compound arcuate surface 818. The upstanding portion 816 is connected to an angular portion 815 which is mounted to the top end of the door section. The compound arcuate surface 818 includes a concave portion 820 having a complementary curvature to the curvature of the convex protrusion portion 812 for mating engagement with the vertical leg 806 of the upper rail 802. The remainder of the surface 818 has a convex curvature. The curvature of the arcuate surface 818 changes from the concave configuration of portion 820 to a convex curvature at an inflection region 822. The inflection region 822 is generally located by measuring from the lower end 814 of the front face 817 to the upper end 824 of the convex protrusion 812 of the upper meeting rail 802. In one arrangement, the radius of curvature R1 of the concave portion 820 is smaller than the radius curvature R2 of the remainder of the arcuate surface 818. This general arrangement provides the benefit of safety for a pinch resistant operation of the garage door. In one configuration, radius of curvature R1 is 15 to 25 mm and is preferably 20 mm, and radius of curvature R2 is 30 to 40 mm and is preferably 34 mm. More preferably, radius of curvature R2 is 34 mm as measured from the center of pivot pin 852. Arrangements having these parameters can provide significant pinch resistant functionality.

FIGS. 24A-E illustrates at least one operational sequence of the meeting rail system acting as a pinch resistant or pinch proof apparatus. The upper rail 802 and the lower 804 have an interlocking function. In the operational sequence, when the door is opened in a fashion as a rollup of the garage door, the meeting rails 802, 804 separate from each other by pivoting on the hinge. During the rotational motion of the meeting rails, the upper rail 802 with the vertical leg 806 moves in a curvilinear manner to generally follow the curvature of the upstanding leg of the lower meeting rail 804. The separation distance is maintained to be sufficiently small between the protrusion portion 812 and the arcuate surface 818 so that a finger of a person is pushed downward, rather than being pinched between the surface 818 and protrusion portion 812.

Similar to the embodiment shown in FIGS. 15-20, lower meeting rail 804 has a flange 846 that can be used to mount or otherwise retain a hinge 850 with pivot pin 852 (see FIGS. 21 and 23). The particular hinge mounting arrangement is shown in FIG. 21. In one embodiment shown in FIG. 21, the pivot pin 852 is provided in a rear position with respect to garage door section. In another embodiment, the pivot pin 852 is disposed in a recessed arrangement between the upper meeting rail 802 and the lower meeting rail 804. This recessed arrangement is provided by a structure of an upper rotation limiter 870 and lower rotation limiter 872, disposed on the upper meeting rail 802 and lower meeting rail 804, respectively. Upper rotation limiter 870 and lower rotation limiter 872 define a rotation limiter system 874 that stops downward rotation of the upper meeting rail 802 with respect to the lower meeting rail 804. (Counter-clockwise rotation as shown in the FIGS. 21 and 24A-24E). Referring to FIGS. 21-23, the upper rotation limiter 870 and lower rotation limiter 872 are planar and angled from the vertical. The distal end of the upper rotation limiter 870 includes a protrusion portion 876 that becomes received in a corresponding shaped cavity 878 on the distal end of the lower rotation limiter 872. This arrangement of the protrusion portion 876 and cavity 878 enables a stable and strong support when the meeting rails 802, 804 are in a closed position. When in meeting rails are in a closed position, the protrusion-cavity arrangement, prevents lateral twisting of the door about a longitudinal axis along the width of the door. In the embodiment shown in FIGS. 21-24E, the protrusion portion 827 has a triangular cross section and is prism-shaped in viewed in a three-dimensional space. This triangular configuration provides a greater sectional area to reduce shearing loads and provides a benefit to prevent lateral twist as noted in the foregoing. Nevertheless, protrusion portion 827 can have other shapes and sizes. Further, in operation, as the protrusion portion 872 of upper rotation limiter 870 enters the cavity 878 of the lower rotation limiter 872, the upper meeting rail 802 becomes generally aligned with the lower meeting rail 804. It should be noted that between 0.5 degrees to 2 degrees from vertical, the upper meeting rail 802 starts to become generally aligned with the lower meeting rail 804 depending on the height of protrusion portion 872.

Figure 24A:
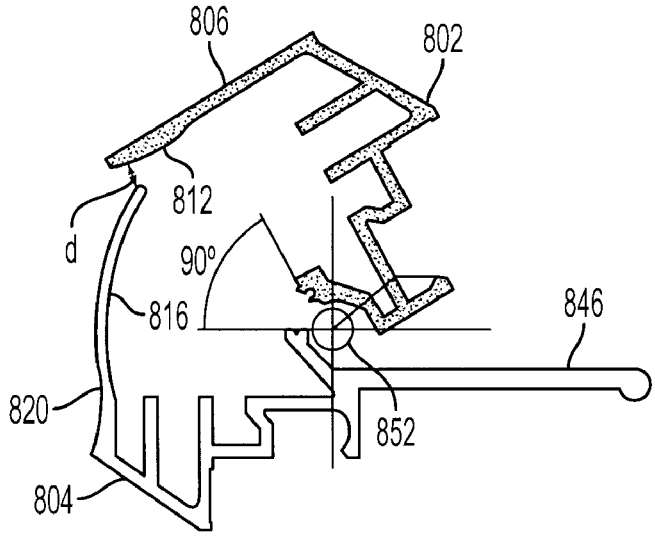
FIGS. 24A-E are cross section views illustrating at least one operational sequence of one embodiment.

FIG. 24A shows at least two adjacent garage door sections in an open position, such as when the upper door section is on a curved section of a guide track. For ease of explanation, the sectional doors are not shown. Hence, FIG. 24A shows upper meeting rail 802 pivoted about pivot pin 852 above lower meeting rail 804. As seen in FIGS. 24A-24E, the pivot pin 852 is provided in a rear position for enabling the upper meeting rail 802 to rotate so that the distance (d) between the convex protrusion 812 and surface 818 is small. This small distance (d) provides safety feature so that finger of a user is pushed away, rather than pinched between door sections.

Figure 24B:
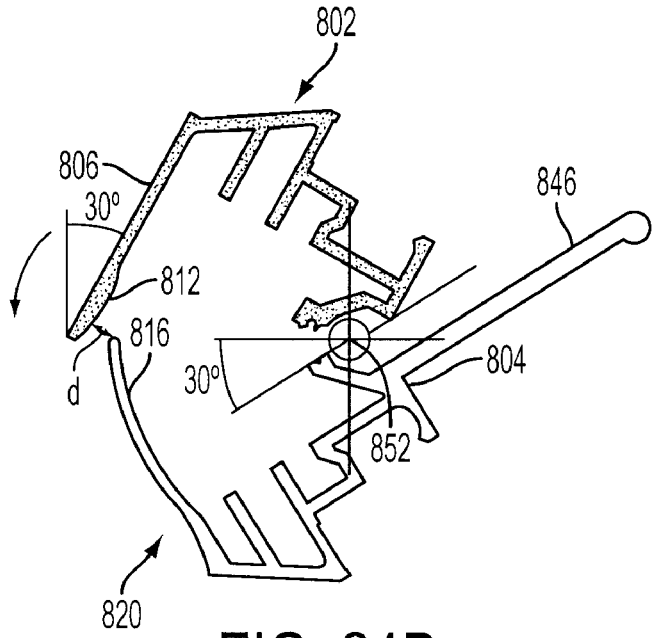
Figure 24C:
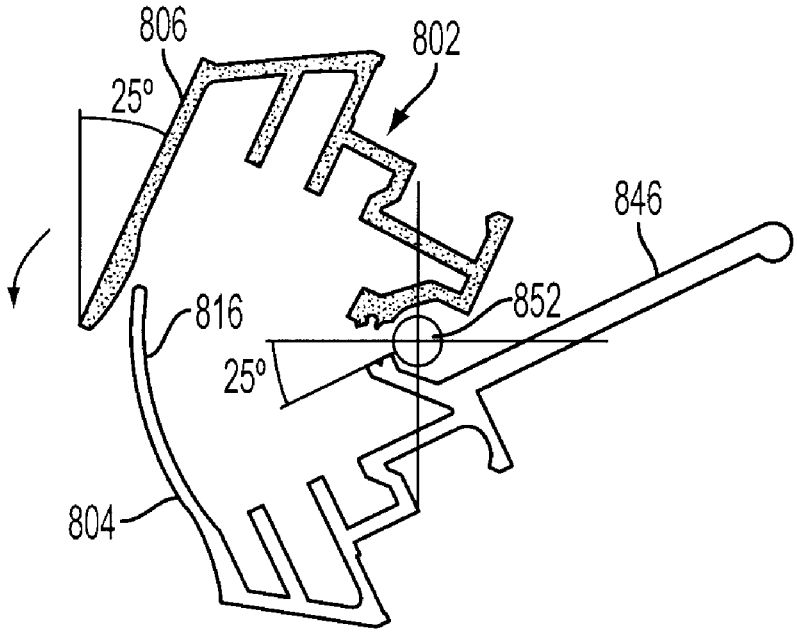
Figure 24D:
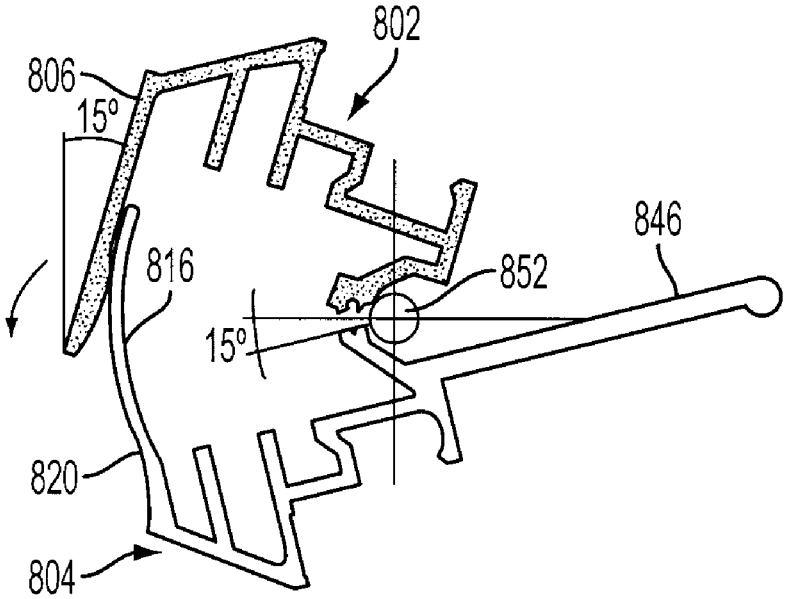
Figure 24E:
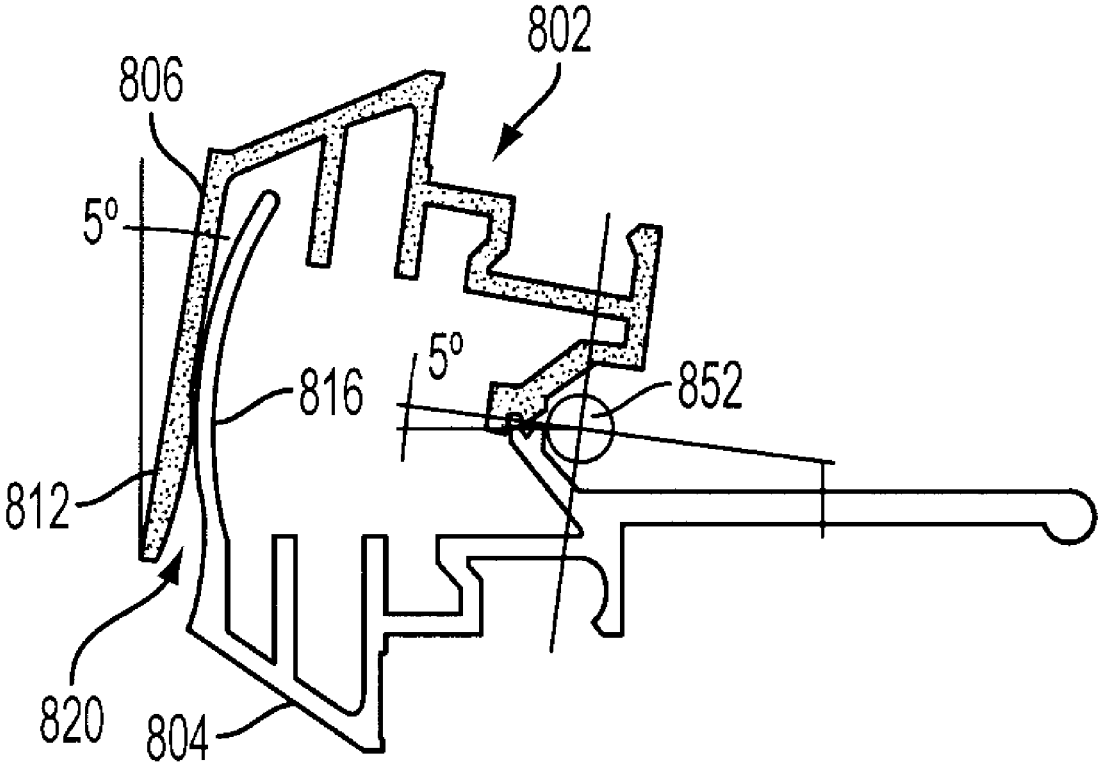

FIG. 24B illustrates the sectional doors in one downward closing position with upper rail approximately 30 degrees from the vertical. FIG. 24C illustrates the sectional doors in a subsequent downward closing position with upper rail approximately 25 degrees from the vertical. FIG. 24D illustrates sectional doors in subsequent downward closing position with upper rail approximately 15 degrees from the vertical. FIG. 24E illustrates sectional doors in another subsequent downward closing position with upper rail approximately 5 degrees from the vertical.

While the meeting rails 802 and 804 provide a safety benefit to prevent pinching of user's finger, the vertical leg of upper rail 802 in combination with the compound arcuate surface 818 of meeting rail 802 aids in the insulation properties of the door. The concave portion 820 of surface 818 having a complementary curvature to the curvature of the convex protrusion portion 812, engagements with the vertical leg 806 of the upper rail 802 to a create a seaming arrangement to prevent air infiltration. The concave-convex configuration can provide protection against air and moisture seeping between the horizontal panels of the door and, thus, provides a substantially weather-tight seal. The concave-convex configuration further encourages precipitation and other fluids contacting the exterior of the door to move downward past the interface for the two meeting rails when the garage door is closed. In general, the overlap seal configuration acts as a barrier against wind, moisture and debris, to reduce undesired infiltration into the garage.

Meeting rails 802 and 804 may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, machining metals, or thermoforming plastic materials. In addition, the meeting rails 802 and 804 can be manufactured to appear as a material similar to that of the rest of the door and of the same color to match the exterior appearance of the door 510 (FIG. 15).

Meeting rails 802 and 804 can be fastening a selected garage door section via bolts or other mechanical fasteners. This configuration is generally illustrated in FIG. 17. Nevertheless, other meeting rails 802 and 804 could be bonded or otherwise attached of the ends of the garage door.

Referring to FIG. 15 and FIGS. 25 through 28A-G, an alternative embodiment of an overhead garage door 510 is shown that illustrates various aspects pertaining to providing another arrangement of a pinch resistant function between the hingedly-connected sections. Referring generally to FIG. 15, garage door 510 may include decorative facade elements, such as light-transmitting panels 512, which simulate two sets of light-transmitting doors commonly known as French doors. However, aspects of the present invention pertaining to pinch resistant functions between the door sections may be practiced with other door configurations, which may or may not simulate light-transmitting doors or include light-transmitting elements.

Referring to FIG. 15, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 25:
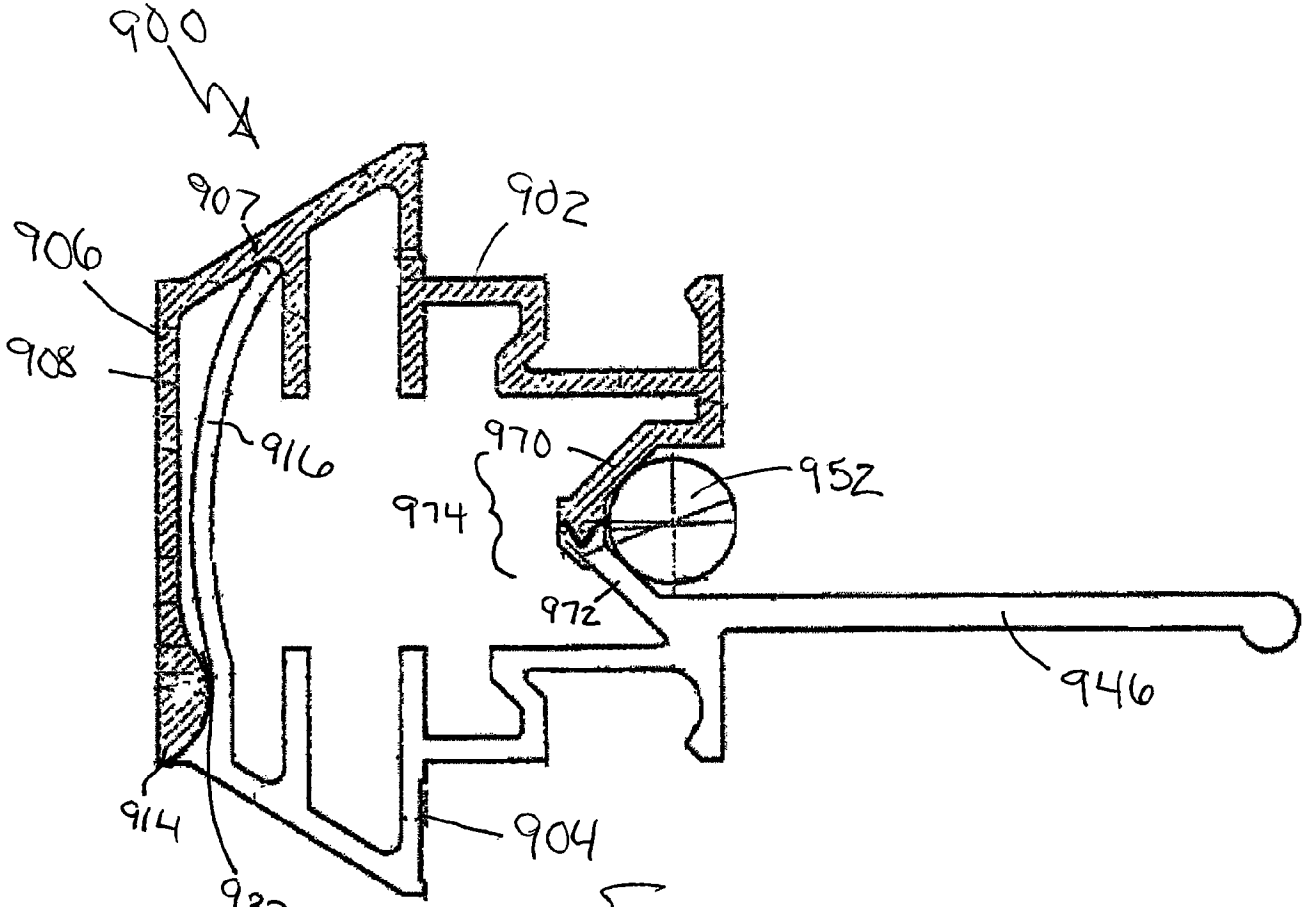
FIG. 25 is a cross sectional view of a meeting railing system according to an alternate arrangement.
Figure 26:
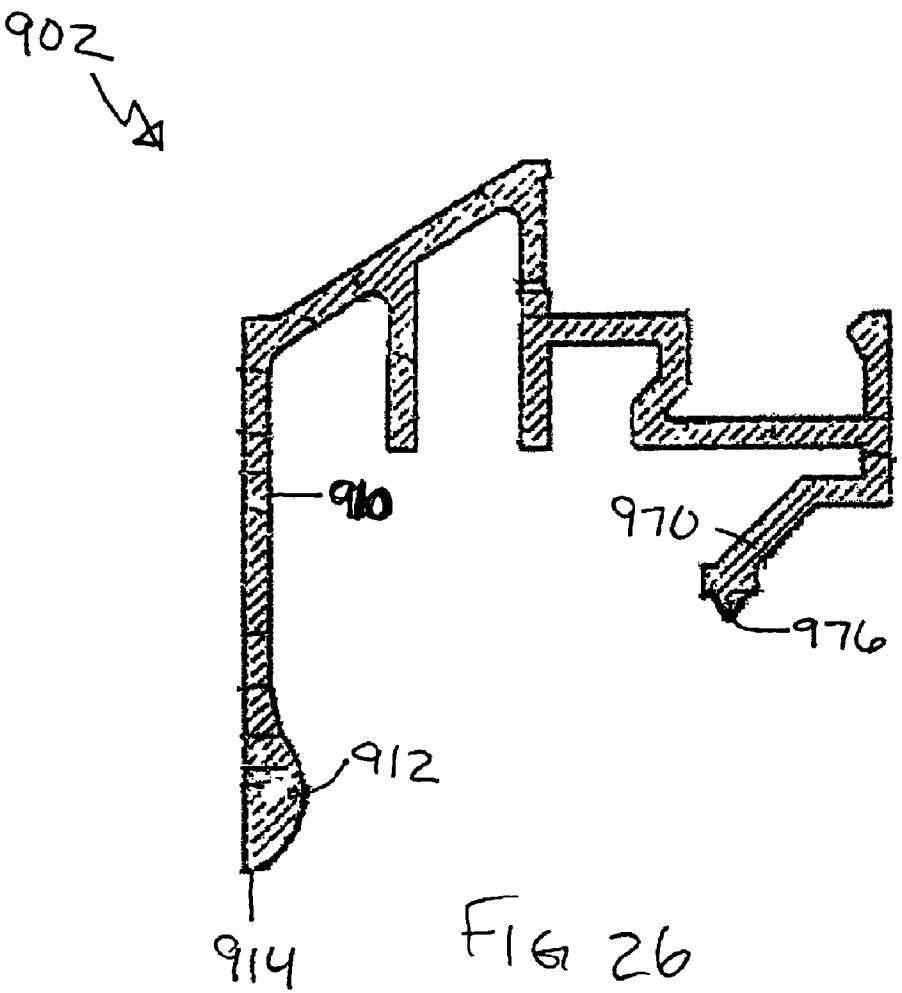
FIG. 26 is a cross sectional view of one member of the meeting railing system shown in FIG. 25.
Figure 27:
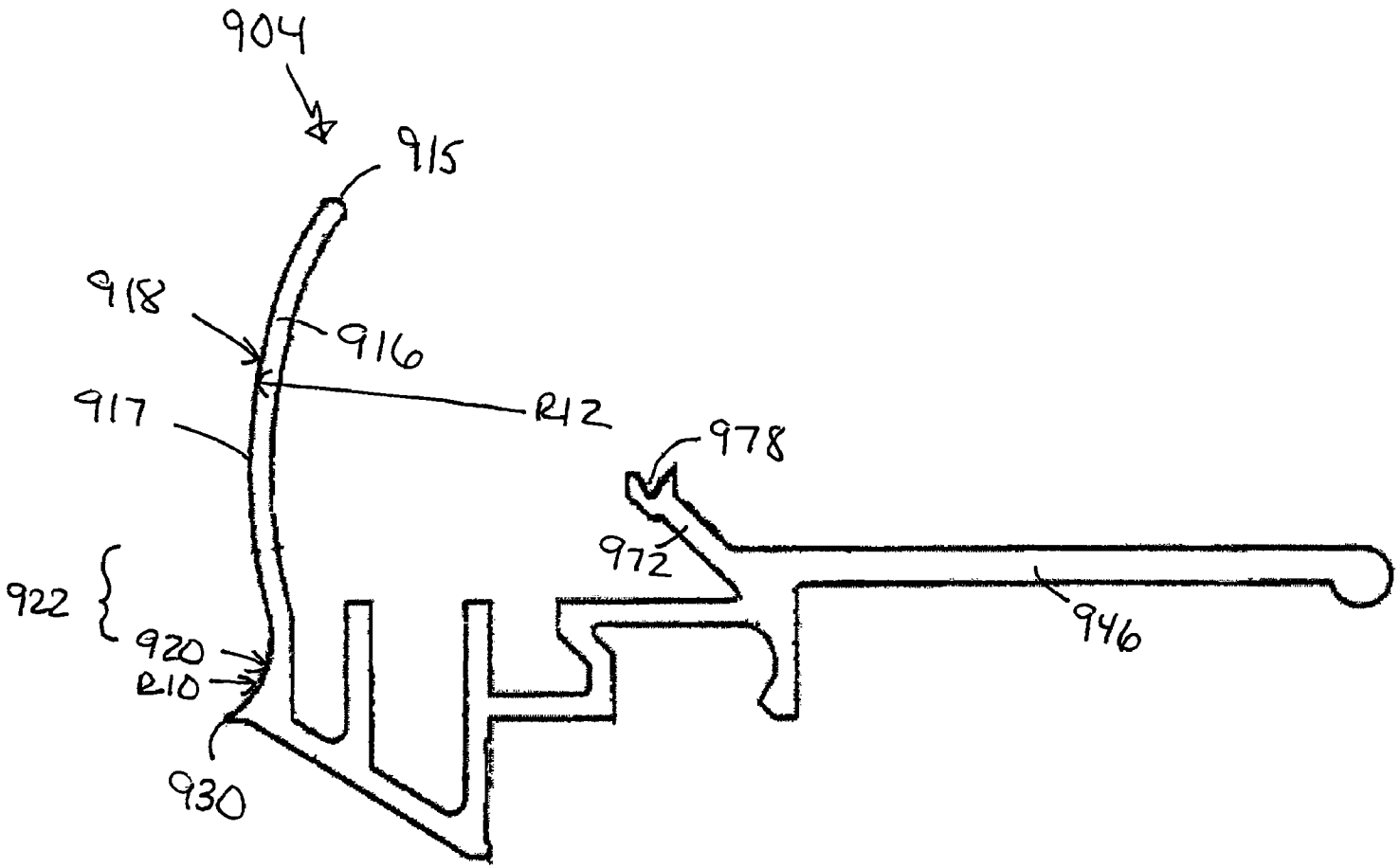
FIG. 27 is a cross sectional view of one member of the meeting railing system shown in FIG. 25.

FIGS. 25-27 illustrate another arrangement of the meeting rail system 900 for a garage door 510 (FIG. 15). The meeting rail system 900 is configured to provide an alternate arrangement for pinch resistant type of garage door to protect the detents of a user's limb, such as a finger of the user, from being engaged between the horizontal sections 532. Meeting rail system 900 comprises an upper rail 902 and a lower rail 904. The upper rail 902 and lower rail 904 are provided between adjacent horizontal sections of the door 510. The upper rail 902 is mounted to the upper horizontal section to extend laterally across the width of the door 510. Likewise, the lower rail is mounted the lower section of the door. The upper rail 902 and the lower rail 904 are hingely connected together to move in a complementary manner when the garage door sections 532 move on the guide track (not shown). In one construction shown in FIGS. 25 and 26, the upper meeting rail 902 includes a vertical leg 906 which has a front face 908 and a rear face 910. The front face 908 is substantially planar, but could have other surface configurations. The rear face 910 is substantially planar in the upper portion and includes a convex protrusion 912 disposed near the distal end 914 of the vertical leg 906. Although the upper portion of the rear face 910 is substantially planar, it could be other configurations. The vertical leg 906 is connected to an angular portion 907 which is mounted to the bottom end of the door section.

Referring to FIGS. 25 and 27, the lower meeting rail 904 is provided with an upstanding portion 916 having a front face 917 with a compound arcuate surface 918. The upstanding portion 916 is connected to an angular portion which is mounted to the top end of the door section. The compound arcuate surface 918 includes a concave portion 920 having a complementary curvature to the curvature of the convex protrusion portion 912 for mating engagement with the vertical leg 906 of the upper rail 902. The remainder of the surface 918 has a convex curvature. The curvature of the arcuate surface 918 changes from the concave configuration of portion 920 to a convex curvature at an inflection region 922. The inflection region 922 is generally located by measuring from the lower end 924 of the front face 917 to the upper end 924 of the convex protrusion 912 of the upper meeting rail 902. In one arrangement, the radius of curvature R10 of the concave portion 920 is smaller than the radius curvature R12 of the remainder of the arcuate surface 918. In another arrangement, the radius of curvature R10 is substantially smaller than the radius of curvature R12. This general arrangement provides the benefit of safety for a pinch resistant operation of the garage door. In one configuration, radius of curvature R10 is 5 to 10 mm and is preferably 7 mm, and radius of curvature R12 is 15 to 25 mm and is preferably 22 mm. Arrangements having these parameters can provide significant pinch resistant functionality.

The concave portion 920 of the lower meeting rail 904 includes a protruding tail 930 at the proximal end. The convex protrusion 912 of the upper meeting rail 902 is arranged such that, when the meeting rail system is in a closed position, that is, when the concave portion 920 and convex protrusion 912 are aligned, the protruding tail 930 substantially covers the distal tip 914 of the vertical leg 906. For instance, the protruding tail 930 extends beyond the seam 932 between the concave portion 920 and the convex protrusion 912 to act as a barrier to access to the seam 932. Such an arrangement can aid in preventing a user's fingers from being pinched within the meeting rails by limiting access to the seam where a user's fingers could become lodged or pinched in a conventional system.

FIGS. 28A-G illustrate at least one operational sequence of the meeting rail system acting as a pinch resistant or pinch proof apparatus. The upper rail 902 and the lower rail 904 have an interlocking function. In the operational sequence, when the door is opened in a fashion as a rollup of the garage door, the meeting rails 902, 904 separate from each other by pivoting on the hinge. During the rotational motion of the meeting rails, the upper rail 902 with the vertical leg 906 moves in a curvilinear manner to generally follow the curvature of the upstanding leg of the lower meeting rail 904. The separation distance between the front face of the arcuate surface 918 and the rear face of the vertical leg 906 of the upper rail 902 is generally sufficiently small that an object, such as the finger of a user, can not fit between the two parts. Further, the arrangement of the convex protrusion 912 and the concave portion 920 allows an object, such as the finger of a user, to be pushed down, rather than becoming lodged, as the upper rail 902 closes on the lower rail 904. The protruding tail 930 further aids in forcing a user's finger downward and away from the meeting rails so that it will not be caught between the two rails 902, 904.

Similar to the embodiment shown in FIGS. 15-20, lower meeting rail 904 has a flange 946 that can be used to mount or otherwise retain a hinge (top and bottom hinge plates shown as 940 and 942 respectively in FIG. 25). The particular hinge arrangement may be similar to the arrangement discussed above. In the arrangement shown in FIG. 25, a pivot pin 952 works in conjunction with the hinge and is disposed in a recessed arrangement between the upper meeting rail 902 and the lower meeting rail 904. This recessed arrangement is provided by a structure of an upper rotation limiter 970 and lower rotation limiter 972 disposed on the upper meeting rail 902 and lower meeting rail 904, respectively. Upper rotation limiter 970 and lower rotation limiter 972 define a rotation limiter system 974 that stops downward rotation of the upper meeting rail 902 with respect to the lower meeting rail 904. (Counter-clockwise rotation as shown in the FIGS. 25 and 28A-28G). As discussed below, the upper rotation limiter 970 also aids in providing a maximum upward rotation for the upper meeting rail 902. (Clockwise rotation shown in FIGS. 25 and 28A-G). Referring to FIGS. 25-27, the upper rotation limiter 970 and lower rotation limiter 972 are planar and angled from the vertical. The distal end of the upper rotation limiter 970 includes a protrusion portion 976 that is received in a corresponding shaped cavity 978 on the distal end of the lower rotation limiter 972. This arrangement of the protrusion portion 976 and cavity 978 enables a stable and strong support when the meeting rails 902, 904 are in a closed position. When the meeting rails are in a closed position, the protrusion-cavity arrangement prevents lateral twisting of the door about a longitudinal axis along the width of the door. In the embodiment shown in FIGS. 25-28G, the protrusion portion 976 has a triangular cross section and is prism-shaped when viewed in a three-dimensional space. This triangular configuration provides a greater sectional area to reduce shearing loads and provides a benefit to prevent lateral twist as noted in the foregoing. Nevertheless, protrusion portion 976 can have other shapes and sizes. Further, in operation, as the protrusion portion 976 of upper rotation limiter 970 enters the cavity 978 of the lower rotation limiter 972, the upper meeting rail 902 becomes generally aligned with the lower meeting rail 904. It should be noted that, in one configuration, between 0.5 degrees to 2 degrees from vertical, the upper meeting rail 902 starts to become generally aligned with the lower meeting rail 904 depending on the height of protrusion portion 972.

Figure 28A:
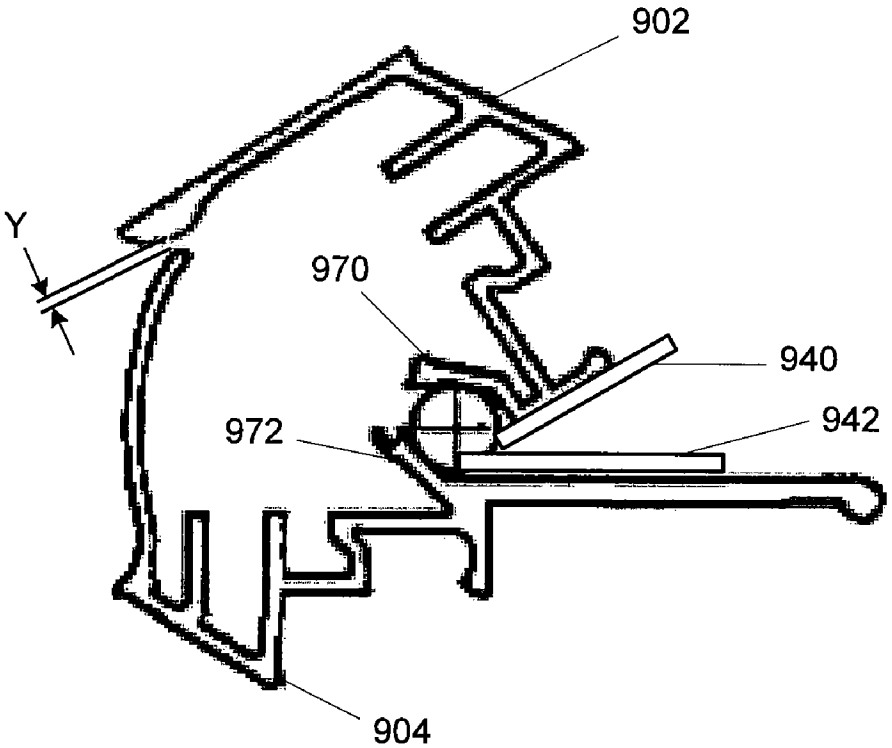
FIGS. 28A-28G are cross sectional views illustrating at least one operational sequence of one arrangement of the meeting railing system of FIG. 25.
Figure 28C:
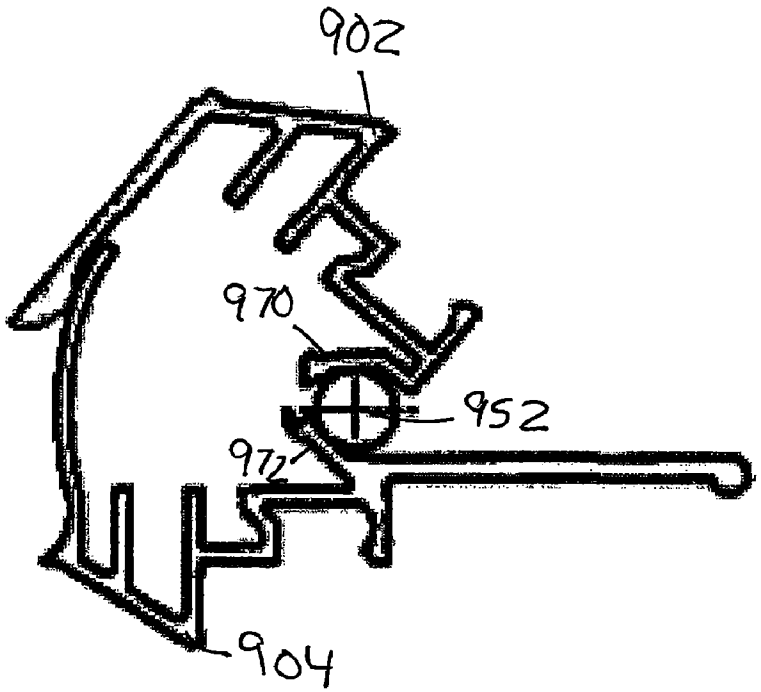
Figure 28B:
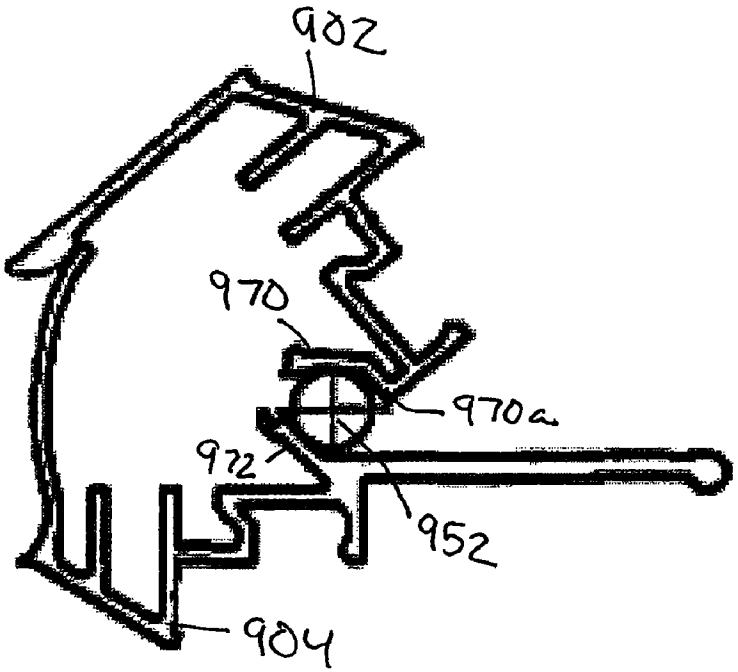
Figure 28E:
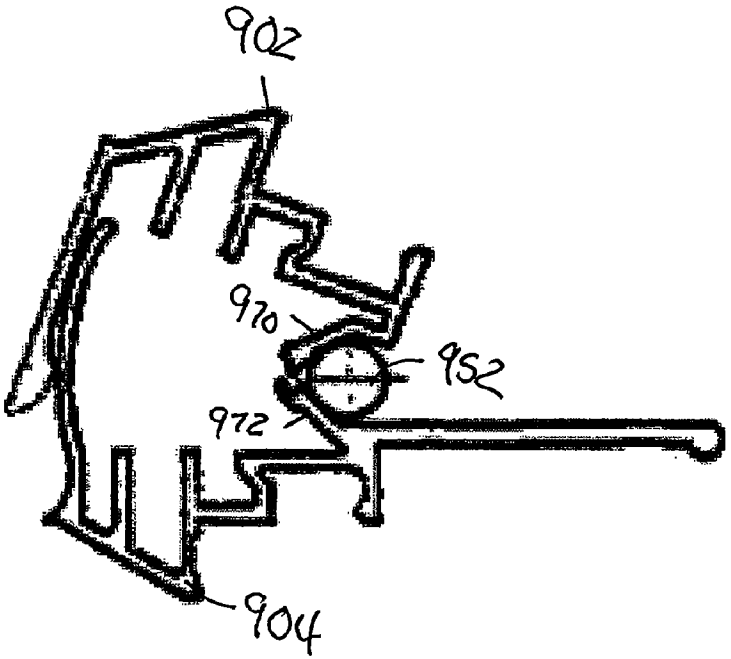
Figure 28D:
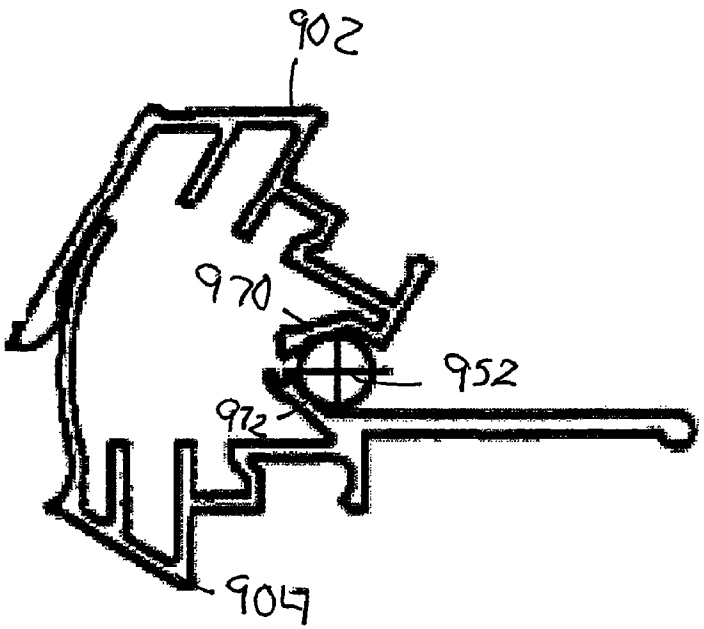
Figure 28G:
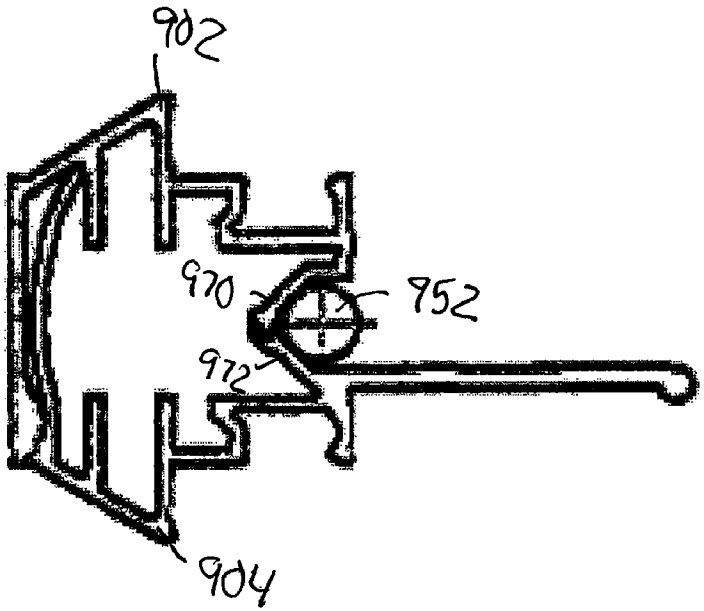
Figure 28F:
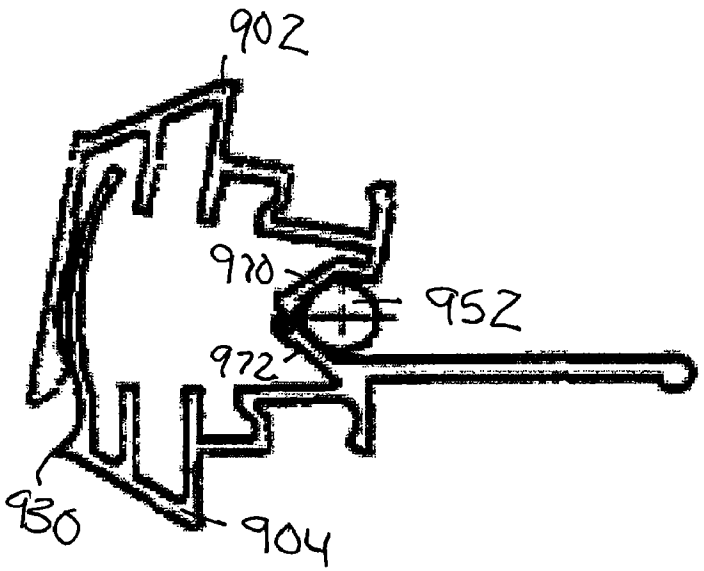

With further reference to FIG. 25, the pivot pin 952 is shown within a relatively enclosed area formed by the upper rotation limiter 970, lower rotation limiter 972 and flange 946. As shown in FIGS. 28A through 28G, as a garage door opens, the upper meeting rail 902 will rotate clockwise around the pivot pin 952. Such rotation can be limited by the arrangement of the pivot pin 952 and the relatively limited space between the upper rotation limiter 970 and lower rotation limiter 972. As shown in FIG. 28A, the upper rotation limiter 970 may only move so far before the top plate of the hinge 940 comes in contact with the bottom plate 942 of the hinge. This contact can prevent the upper meeting rail 902 from rotating beyond a certain point. For instance, in one illustrative arrangement, the upper meeting rail may rotate to a maximum open position between 55° and 60° from horizontal. In another arrangement, the upper meeting rail may rotate to a maximum open position of 57° from horizontal. This position, shown in FIG. 28A, ensures relatively limited space (shown as gap Y) between the convex protrusion 912 of the upper meeting rail leg 906 and the distal end 915 of upstanding portion 916 of the lower meeting rail 904. The relatively small gap Y between these two parts further aids in providing a pinch-proof mechanism by providing a gap that is, generally speaking, too small for the finger of a user to fit into. In other arrangements, the maximum open position may prevent any gap from occurring between the convex protrusion 912 of the upper meeting rail leg 906 and the distal end 915 of upstanding portion 916 of the lower meeting rail 904. In further arrangements, the hinge plates may not be configured to act as rotation limiters and the maximum opening may be limited in other ways, such as by the bend radius of the garage door as it moves between horizontal and vertical positions.

FIG. 28A shows at least two adjacent garage door sections in an open position. For ease of explanation, the sectional doors are not shown. Hence, FIG. 28A shows upper meeting rail 902 pivoted about pivot pin 952 above lower meeting rail 904. As shown in FIGS. 28A-28G, the pivot pin 952 is provided in a rear position for enabling the upper meeting rail 902 to rotate so that the gap Y (FIG. 28A) between the convex protrusion 912 and the distal end of the upstanding portion 916 of the lower meeting rail 904 is small. The gap Y may be sufficiently small to prevent an object, such as the finger of a user to become lodged or pinched between the upper meeting rail 902 and the lower meeting rail 904. As also shown in FIGS. 28A-28G, should a user's finger come in contact with the upstanding portion 916 of the lower meeting rail 904 during operation of the garage door, the shape of the convex protrusion 912 may prevent the finger from becoming pinched as the meeting rails rotate to a closed position and will encourage the finger downward and away from the meeting rail system.

FIG. 24B illustrates the sectional doors in one downward closing position with upper rail approximately 50° from horizontal. As shown, the gap Y (FIG. 28A) is generally closed to prevent an object from being pinched between the upper and lower rails. FIG. 24C illustrates the sectional doors in a subsequent downward closing position with upper rail approximately 40° from horizontal. FIG. 24D illustrates sectional doors in a subsequent downward closing position with upper rail approximately 30° from horizontal. FIG. 24E illustrates sectional doors in another subsequent downward closing position with upper rail approximately 20° from horizontal. FIG. 24F illustrates sectional doors in yet another subsequent downward closing position with the upper rail approximately 10° from horizontal. FIG. 24G illustrates sectional doors in a substantially closed position with the upper rail approximately 0° from horizontal.

As shown in the sequence of FIGS. 28A-28G, the shape and rotation of the meeting rails may prevent pinching between the meeting rails and may force an object downward and away from the meeting rail system as the sectional doors are closing. The tail protrusion further aids in forcing any object in contact with the upstanding portion 916 of the lower meeting rail 904 away from the meeting rail system.

While the meeting rails 902 and 904 provide a safety benefit to prevent pinching of user's finger, the vertical leg of upper rail 902 in combination with the compound arcuate surface 918 of meeting rail 902 aids in the insulation properties of the door. The concave portion 920 of surface 918 having a complementary curvature to the curvature of the convex protrusion portion 912, engagements with the vertical leg 906 of the upper rail 902 to a create a seaming arrangement to prevent air infiltration. The concave-convex configuration can provide protection against air and moisture seeping between the horizontal panels of the door and, thus, provides a substantially weather-tight seal. The concave-convex configuration further encourages precipitation and other fluids contacting the exterior of the door to move downward past the interface for the two meeting rails when the garage door is closed. In general, the overlap seal configuration acts as a barrier against wind, moisture and debris, to reduce undesired infiltration into the garage.

Meeting rails 902 and 904 may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, machining metals, or thermoforming plastic materials. In addition, the meeting rails 802 and 804 can be manufactured to appear as a material similar to that of the rest of the door and of the same color to match the exterior appearance of the door 510 (FIG. 15).

Meeting rails 902 and 904 can be fastening a selected garage door section via bolts or other mechanical fasteners. This configuration is generally illustrated in FIG. 17. Nevertheless, other meeting rails 902 and 904 could be bonded or otherwise attached of the ends of the garage door.

Although the subject matter has been described in language specific to structural features, it is to be understood that the subject matter defined in the appended claims is not necessarily limited to the specific features described above. Rather, the specific features described above are disclosed as example forms for implementing the claims. Further, it is appreciated that aspects of the invention discussed herein may be practiced alone or in combination with other aspects, and they may be practiced in a variety of door configurations.

The invention claimed is:

1. A sectional overhead garage door, comprising:

a first door section;

a second door section, the first door section and the second door section being configured to be hingely attached to each other;

an upper rail being attached to a bottom portion the first door section and having a front vertical leg extending downward toward the second door section when in a closed position, the front vertical leg having a rear face and a convex protrusion at a distal end of the rear face;

a lower rail being attached to an upper portion of the second door section, the lower rail having a front face and a multiple arcuate surface on the front face, the multiple arcuate surface having an upper convex portion, a concave portion which mates with the upper rail convex protrusion extending rearward into the concave portion of the lower rail and toward a front surface of the overhead garage door when the first section and the second section are in the closed position, and an inflection region between the upper convex portion and the concave portion, the lower rail further including a flange that protrudes outward, beyond the plane of the door;

wherein the upper rail front vertical leg moves in a curvilinear manner to follow the curvature of the upper convex portion of the lower rail during rotational motion of the upper and lower rails relative to each other; and a first rotation limiter provided on the upper meeting rail and a second rotation limiter provided on the lower meeting rail, the first rotation limiter configured to be received in the second rotation limiter.

2. The garage door of claim 1, wherein the concave portion of the lower rail has a radius of curvature which is smaller than a radius of curvature of its convex portion.

3. The garage door of claim 1, wherein the upper rail and the lower rail comprise a metal material.

4. The garage door of claim 3, wherein the upper rail and the lower rail comprise aluminum.

5. The garage door of claim 4, wherein the upper rail and the lower rail are made from an extrusion process.

6. The garage door of claim 1, wherein the upper rail convex protrusion has the same radius value as the radius value of the lower rail concave portion.

7. The garage door of claim 1 incorporating decorative elements of a house façade and further comprising:

at least a first plurality of light-transmitting panels on the door having a plurality of rows and a plurality of columns and configured to give the appearance of a French door;

a plurality of horizontal panels arranged in a stack including the first section and the second section, wherein the plurality of light-transmitting panels are located on the horizontal panels;

a pinch resistant apparatus between adjacent ones of the horizontal panels; and a hinge connecting adjacent ones of the plurality of horizontal panels.

8. The garage door of claim 7, wherein the pinch resistant apparatus comprises the upper meeting rail and the lower meeting rail.

9. The garage door of claim 1, wherein the upper meeting rail and the lower meeting rail conceal a seam formed by the first door section and the second door section.

10. The garage door of claim 1, wherein the lower rail flange is configured to receive a hinge plate.

* * * * *